US006873107B2

(12) United States Patent
Kawai et al.

(10) Patent No.: US 6,873,107 B2
(45) Date of Patent: Mar. 29, 2005

(54) GAS DISCHARGE TUBE HAVING MULTIPLE STEM PINS

(75) Inventors: Koji Kawai, Hamamatsu (JP); Yoshinobu Ito, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/416,546

(22) PCT Filed: Nov. 15, 2001

(86) PCT No.: PCT/JP01/09988

§ 371 (c)(1),
(2), (4) Date: May 13, 2003

(87) PCT Pub. No.: WO02/41357

PCT Pub. Date: May 23, 2002

(65) Prior Publication Data

US 2004/0046506 A1 Mar. 11, 2004

(30) Foreign Application Priority Data

Nov. 15, 2000 (JP) ..... 2000-348415

(51) Int. Cl.[7] ..... H01J 17/18; H01J 17/02

(52) U.S. Cl. ..... 313/623; 313/609; 313/611; 313/292

(58) Field of Search ..... 313/292, 631, 313/623, 634, 609–612

(56) References Cited

U.S. PATENT DOCUMENTS 3,501,665 A * 3/1970 Heinz et al. ..... 313/146
3,508,106 A * 4/1970 Lajos ..... 313/231.61
5,886,470 A 3/1999 Smolka ..... 313/637

FOREIGN PATENT DOCUMENTS

| | | |
|---|---|---|
| JP | 54-141780 | 10/1979 |
| JP | 06-310101 | 11/1994 |
| JP | 07-326324 | 12/1995 |
| JP | 08-077965 | 3/1996 |
| JP | 08-077969 | 3/1996 |
| JP | 08-077979 | 3/1996 |
| JP | 08-222185 | 8/1996 |
| JP | 08-222186 | 8/1996 |
| JP | 08-236081 | 9/1996 |

* cited by examiner

*Primary Examiner*—Vip Patel
*Assistant Examiner*—Anthony Perry
(74) *Attorney, Agent, or Firm*—Morgan, Lewis & Bockius LLP

(57) ABSTRACT

In order to obtain light of a high luminance in a gas discharge tube of the present invention, a discharge path is narrowed by a first opening 18 and a second opening 13 in collaboration. Further, in order to provide favorable start-ability in a lamp even when the discharge path is narrowed, a predetermined voltage is applied from the outside to first and second discharge path limiting portions 16, 12. As a result, an active starting discharge which is capable of passing through the first and second openings is produced between a cathode portion 20 and the first and second discharge path limiting portions 16, 12, and thus discharge between the cathode portion 20 and an anode portion 8 is started speedily. Further, the anode portion, cathode portion, first discharge path limiting portion, and second discharge path limiting portion are housed within a light-emitting portion assembly 6 and electrically connected by first through fourth stem pins 9A to 9D, and the stem pins are utilized effectively to support the light-emitting portion assembly.

15 Claims, 37 Drawing Sheets

GAS DISCHARGE TUBE HAVING MULTIPLE STEM PINS

TECHNICAL FIELD

The present invention relates particularly to a gas discharge tube for use as a light source in a spectroscope, in chromatography, and so on.

BACKGROUND ART

Japanese Patent Application Laid-open Publication H6-310101 discloses conventional technology in this field. In a gas (deuterium) discharge tube described in this publication, two metallic partition walls are disposed on a discharge path between an anode and a cathode, a small hole is formed in each partition wall, and the discharge path is narrowed by these small holes. As a result, light of a high luminance can be obtained by means of the small holes on the discharge path. If three or more metallic partition walls are provided, even higher luminance is obtained, and the luminance of the light increases as the small holes are made smaller.

DISCLOSURE OF THE INVENTION

However, the following problems exist in the conventional gas discharge tube described above. That is, no voltage is applied to the metallic partition walls, and the small holes in the metallic partition walls are used simply to narrow the discharge path. Accordingly, as is described in the publication itself, although luminance may indeed be increased by narrowing the discharge path, the discharge starting voltage must be significantly increased as the small holes are reduced in diameter, causing severe limitations on the diameter of the small holes and the number of metallic partition walls. Note that Japanese Patent Application Laid-Open Publication H7-326324, Japanese Patent Application Laid-Open Publication H8-236081, Japanese Patent Application Laid-Open Publication H8-77965, Japanese Patent Application Laid-Open Publication H8-77969, Japanese Patent Application Laid-Open Publication H8-77979, Japanese Patent Application Laid-Open Publication H8-222185, Japanese Patent Application Laid-Open Publication H8-222186, and so on, submitted by the same company, disclose technology for fixing a light-emitting portion assembly in a hermetically sealed container in a floating state using stem pins.

The present invention has been designed in order to solve the aforementioned problems, and it is a particular object thereof to provide a gas discharge tube in which favorable startability is provided while realizing high luminance, and in which a light-emitting portion assembly fixed inside a hermetically sealed container in a floating state can be securely supported.

A gas discharge tube according to the present invention is caused to discharge a predetermined light from a light exit window of a hermetically sealed container toward the outside by sealing gas into the hermetically sealed container, electrically connecting an anode portion and a cathode portion respectively to first and second stem pins disposed in a standing position in a stem which is provided on the hermetically sealed container so as to extend in a tube axis direction, and generating discharge between the anode portion and cathode portion, and is characterized in comprising: a first discharge path limiting portion disposed at a point on a discharge path between the anode portion and cathode portion and having a first opening for narrowing the discharge path; a second discharge path limiting portion disposed at a point on the discharge path between the first discharge path limiting portion and the anode portion and having a second opening for narrowing the discharge path; an electrical insulation portion disposed between the first discharge path limiting portion and second discharge path limiting portion; a third stem pin disposed in a standing position in the stem so as to extend in the tube axis direction, the distal end part of which is electrically connected to the first discharge path limiting portion; a fourth stem pin disposed in a standing position in the stem so as to extend in the tube axis direction, the distal end part of which is electrically connected to the second discharge path limiting portion; and a light-emitting portion assembly which houses the anode portion, cathode portion, first discharge path limiting portion, and second discharge path limiting portion, and which is supported by the first through fourth stem pins.

When high luminance light is to be produced, it is not simply a case of reducing the diameter of the opening parts for narrowing the discharge path since the more the diameter thereof is reduced, the more difficult it becomes to generate discharge when the lamp is activated. Moreover, in order to improve the startability of the lamp, an extremely large potential difference must be generated between the cathode portion and anode portion, as a result of which the longevity of the lamp is reduced, as has been confirmed experientially. Hence in order to obtain high luminance light in the gas discharge tube of the present invention, the discharge path is narrowed by the first opening and second opening in collaboration. Further, in order to provide favorable startability in the lamp even when the discharge path is narrowed, a predetermined voltage is applied from the outside to the first and second discharge path limiting portions. As a result, an active starting discharge which is capable of passing through the first and second openings is produced between the cathode portion and the first and second discharge path limiting portions, and thus discharge between the cathode portion and anode portion is started speedily. By means of such a constitution, further reductions in the area of the openings in the discharge path limiting portions can be made easily in order to precipitate high luminance while maintaining favorable startability and without drastically raising the start-up voltage of the lamp. Furthermore, the anode portion, cathode portion, first discharge path limiting portion, and second discharge path limiting portion are housed within a light-emitting portion assembly and electrically connected by first through fourth stem pins. Thus at least four stem pins are disposed in a standing position in the stem and each stem pin is utilized effectively to support the light-emitting portion assembly. Hence the vibration resistance quality of the light-emitting portion assembly which is disposed in a floating state within the hermetically sealed container can be improved.

The second discharge path limiting portion is preferably disposed on an electrically insulating support portion so as to contact this support portion. By employing such a constitution, the second discharge path limiting portion can be disposed inside the hermetically sealed container in a stable state.

It is further preferable that the second discharge path limiting portion be fixed by being gripped between the electrical insulation portion and the support portion. This constitution has been designed with a view to facilitating assembly of the gas discharge tube and ensures that the second discharge path limiting portion is securely fixed within the hermetically sealed container. This constitution also appropriately prevents movement of the second discharge path limiting portion caused by thermal expansion occurring when the second discharge path limiting portion reaches a high temperature during an operation of the lamp.

It is also preferable that the gas discharge tube of the present invention further comprise a third discharge path limiting portion disposed at a point on the discharge path between the second discharge path limiting portion and the anode portion and having a third opening for narrowing the discharge path, and a fifth stem pin disposed in a standing position in the stem so as to extend in the tube axis direction, the distal end part of which is electrically connected to the third discharge path limiting portion. This constitution enables a gradual narrowing of the discharge path by means of a collaboration between the openings of the discharge path limiting portions, leading to a further increase in luminance and a further improvement in startability.

It is also preferable that an electrical insulation portion be disposed between the second discharge path limiting portion and third discharge path limiting portion. By employing such a constitution, different voltages can be respectively applied to the second discharge path limiting portion and third discharge path limiting portion, thereby improving startability.

It is also preferable that a higher voltage be applied to the third discharge path limiting portion than to the second discharge path limiting portion. By employing such a constitution, an appropriate discharge starting voltage can be applied between the second discharge path limiting portion and third discharge path limiting portion in accordance with the potential difference between the cathode portion and anode portion, and thus a starting discharge can be generated smoothly.

It is further preferable that the third discharge path limiting portion be disposed on an electrically insulating support portion so as to contact this support portion. By employing such a constitution, the third discharge path limiting portion can be disposed within the hermetically sealed container in a stable state.

Further, the third discharge path limiting portion is preferably fixed by being gripped between the electrical insulation portion and support portion. This constitution has been designed with a view to facilitating assembly of the gas discharge tube, and ensures that the third discharge path limiting portion is securely fixed within the hermetically sealed container. This constitution also appropriately prevents movement of the third discharge path limiting portion caused by thermal expansion occurring when the third discharge path limiting portion reaches a high temperature during an operation of the lamp.

It is further preferable that the second opening have a smaller opening area than the first opening. This enables gradual narrowing of the opening.

Further, the first opening of the first discharge path limiting portion preferably comprises a funnel-shaped part which decreases in diameter from the light exit window toward the anode portion. By means of this funnel-shaped part, discharge can be easily converged in the first opening, whereby an arc ball can be reliably generated in this part and expansion of the arc ball can be appropriately prevented. It is also preferable that a higher voltage be applied to the second discharge path limiting portion than to the first discharge path limiting portion. By employing such a constitution, an appropriate discharge starting voltage can be applied between the first discharge path limiting portion and second discharge path limiting portion in accordance with the potential difference between the cathode portion and anode portion, and thus a starting discharge can be generated smoothly.

BEST MODES FOR CARRYING OUT THE INVENTION

Preferred embodiments of a gas discharge tube according to the present invention will be described in detail below on the basis of the drawings.

(First Embodiment)

Figure 1:
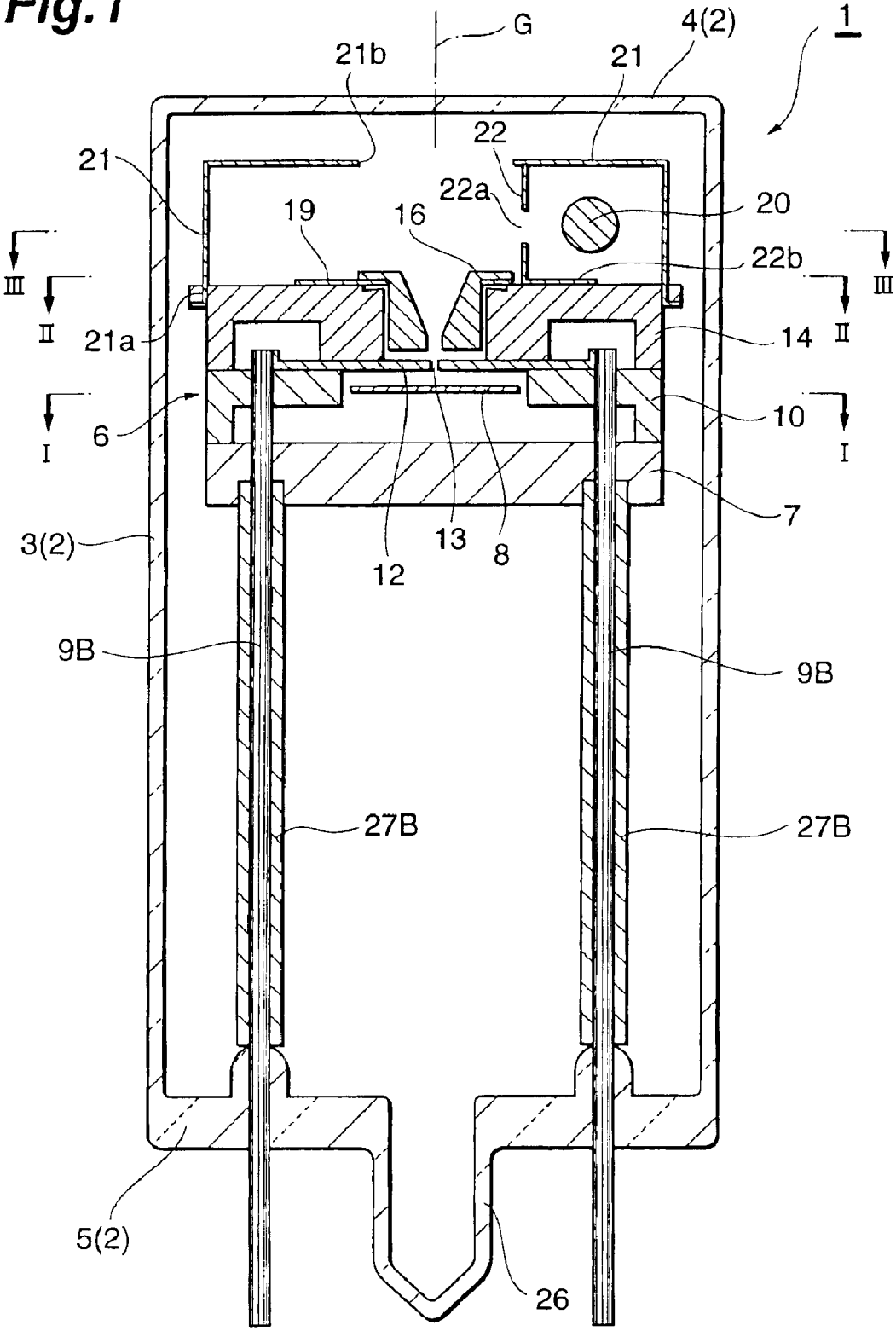
FIG. 1 is a sectional view showing a first embodiment of a gas discharge tube.
Figure 2:
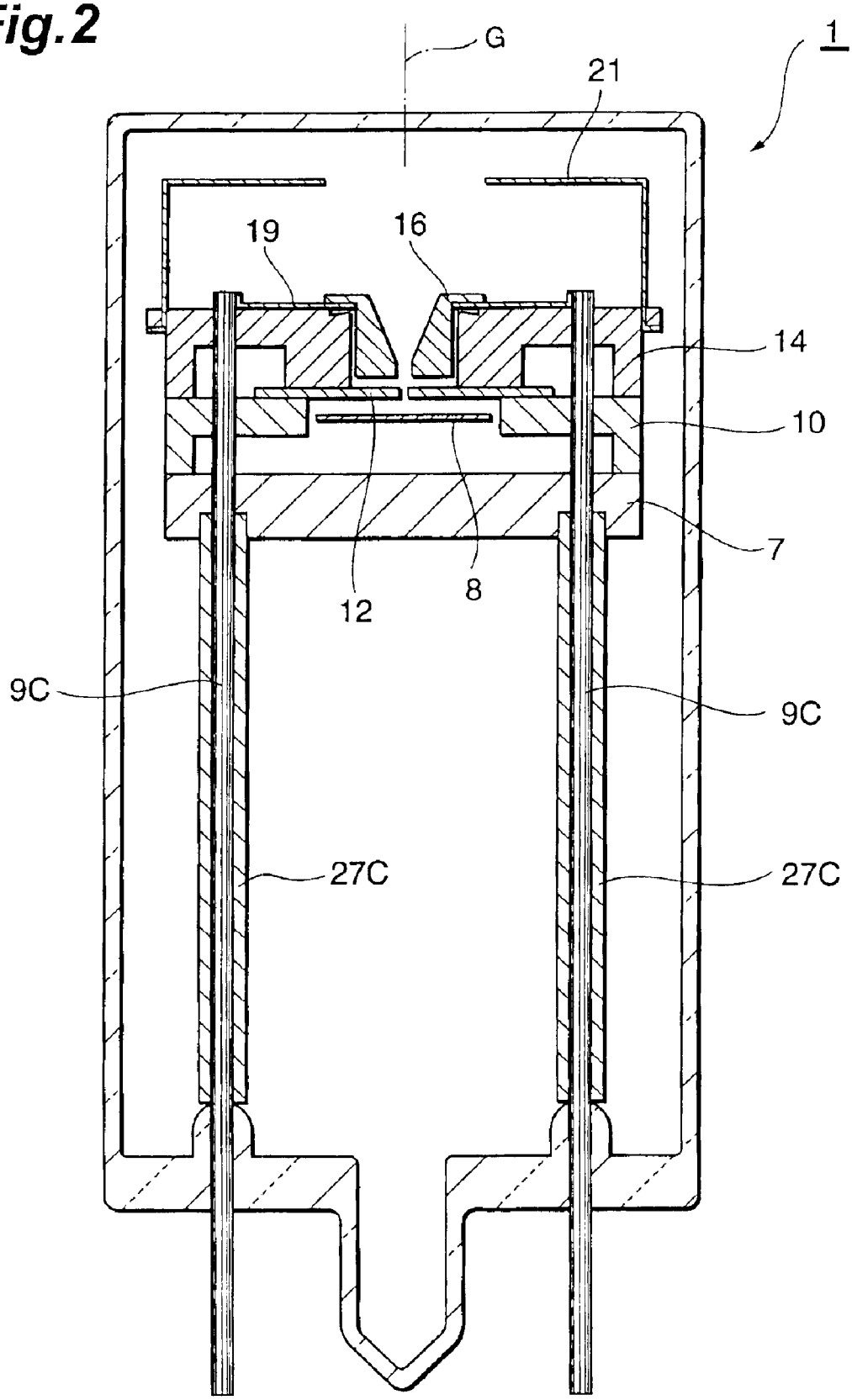
FIG. 2 is a sectional view of the gas discharge tube shown in FIG. 1.

As shown in FIGS. 1 and 2, a gas discharge tube 1 is a head-on type deuterium lamp. The gas discharge tube 1 comprises a glass hermetically sealed container 2 into which deuterium gas is sealed at approximately several hundred Pa. The hermetically sealed container 2 is constituted by a cylindrical side tube 3, a light exit window 4 which seals one side of the side tube 3, and a stem 5 which seals the other side of the side tube 3. A light-emitting portion assembly 6 is housed inside the hermetically sealed container 2.

Figure 3:
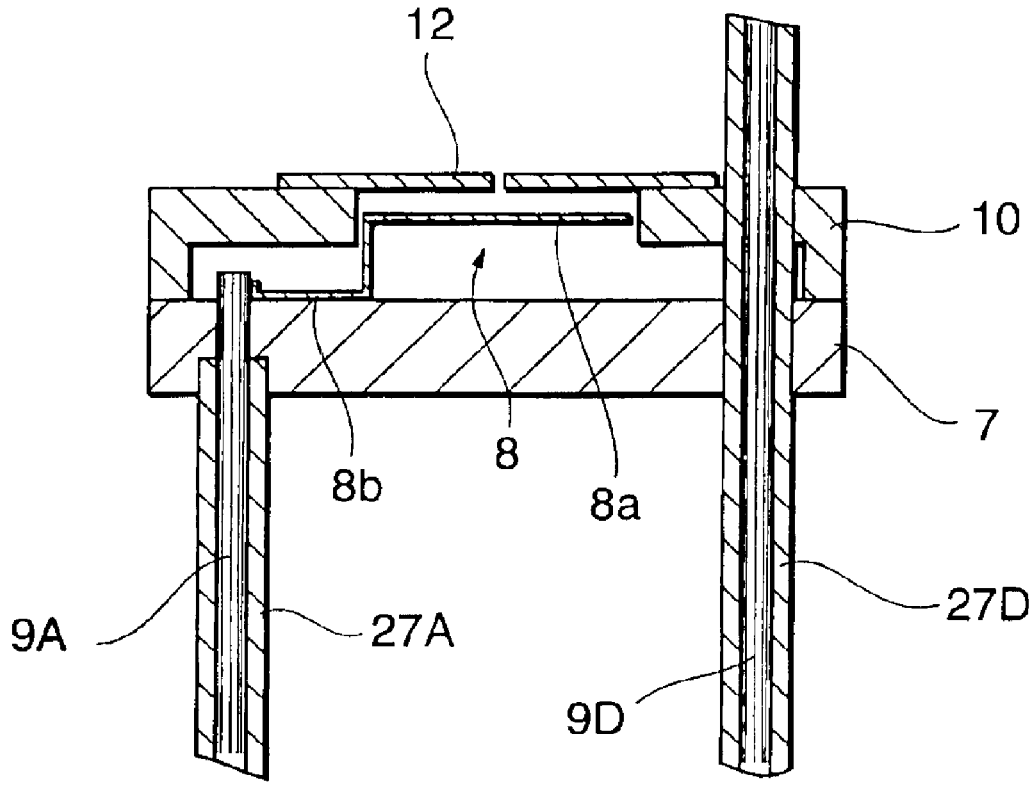
FIG. 3 is an enlarged sectional view of the main parts of an anode portion.
Figure 4:
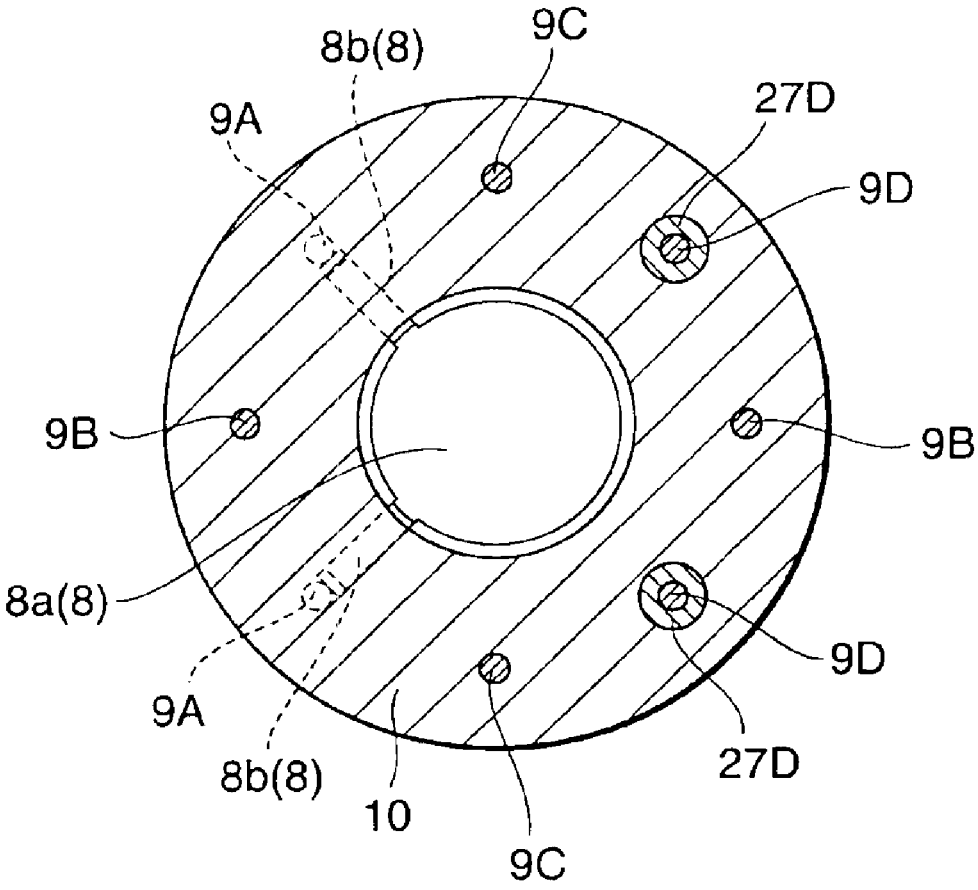
FIG. 4 is a sectional view along the I—I line in FIG. 1.
Figure 9:
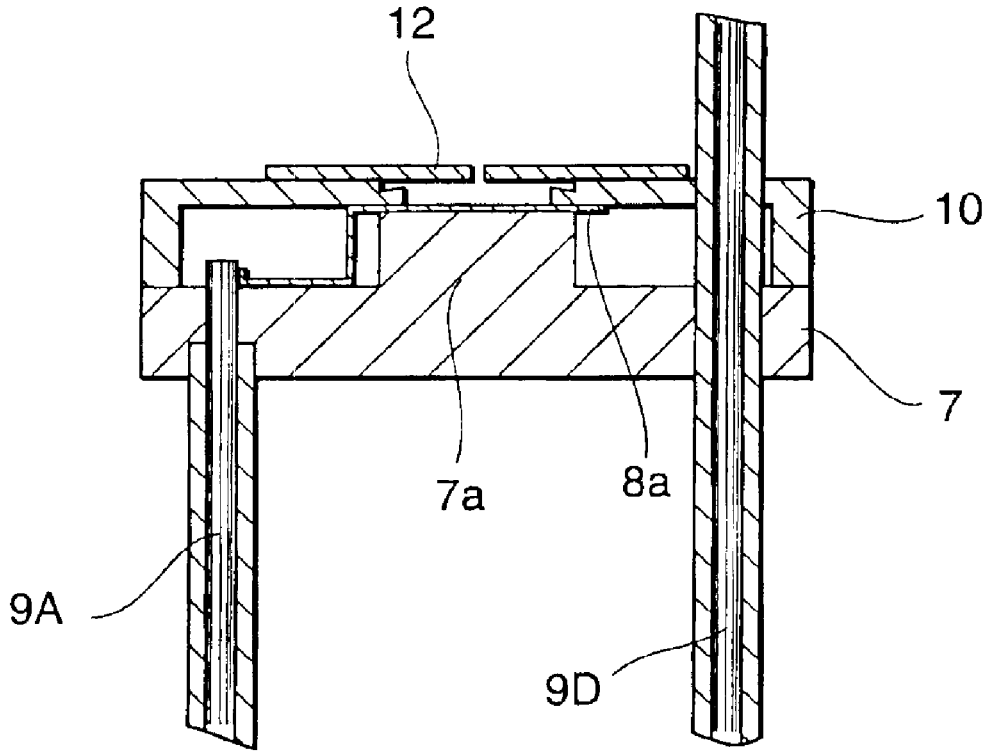
FIG. 9 is a sectional view showing another method for fixing the anode portion.

The light-emitting portion assembly 6 comprises a disk-form electrical insulation portion (first support portion) 7 made of an electrically insulating ceramic. As shown in FIGS. 3 and 4, an anode plate (anode portion) 8 is disposed on the electrical insulation portion 7. A circular main body portion 8*a* of the anode plate 8 is removed from the electrical insulation portion 7, and two lead portions 8*b* extending from the main body portion 8*a* are electrically connected to the respective distal end parts of anode stem pins (first stem pins) 9A which are disposed in a standing position in the stem 5 so as to extend in the direction of a tube axis G. Note that the main body portion 8*a* may be fixed by being gripped between the upper face of a convex portion 7*a* provided on the electrical insulation portion 7 and the rear face of a second support portion 10 to be described hereinafter (see FIG. 9).

As shown in FIGS. 1 and 2, the light-emitting portion assembly 6 comprises a disk-form electrical insulation portion (second support portion) 10 made of an electrically insulating ceramic. This second support portion 10 is placed on the first support portion 7 so as to be superposed thereon, and is formed with an identical diameter to the first support portion 7. A circular discharge opening 11 is formed in the center of the second support portion 10, and this discharge opening 11 is formed such that the main body portion 8*a* of the anode plate 8 peeks out therefrom (see FIG. 4). A disk-form metallic discharge path limiting plate (second discharge path limiting portion) 12 is caused to contact the upper face of the second support portion 10, and thus the main body portion 8*a* of the anode plate 8 and the discharge path limiting plate 12 are caused to oppose one another.

Figure 5:
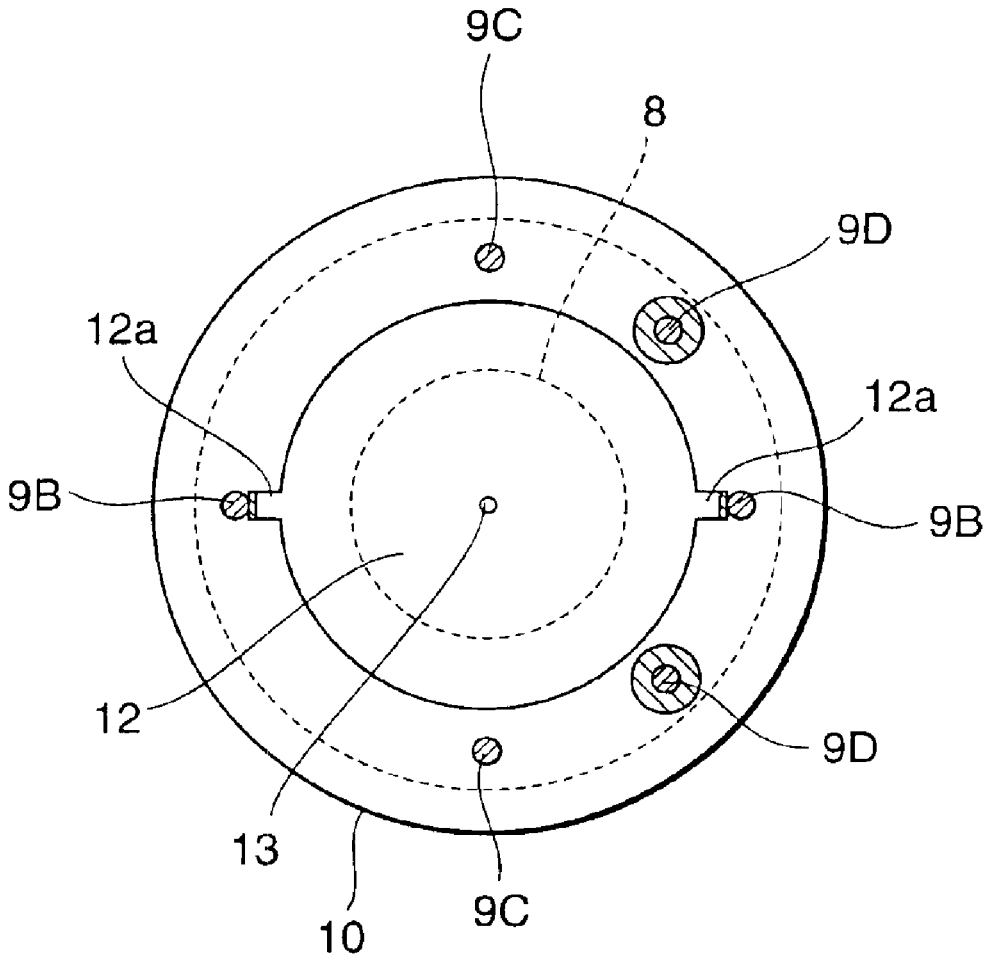
FIG. 5 is a plan view showing a second discharge path limiting portion.

As shown in FIG. 5, a small hole (second opening) 13 with a 0.2 mm diameter is formed in the center of the discharge path limiting plate 12 for narrowing the discharge path. Two lead portions 12*a* are provided on the discharge path limiting plate 12, and each lead portion 12*a* is electrically connected to the respective distal end parts of discharge path limiting plate stem pins (fourth stem pins) 9B which are provided in a standing position in the stem 5.

Figure 6:
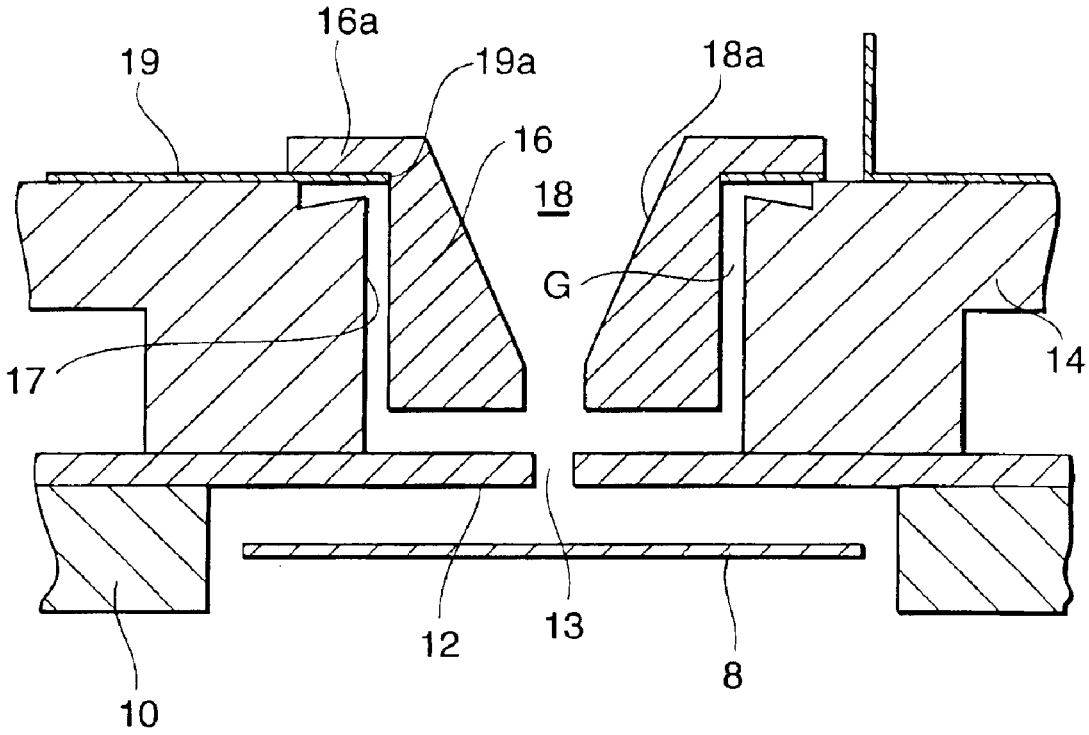
FIG. 6 is an enlarged sectional view of the main parts of the discharge path limiting portion.
Figure 10:
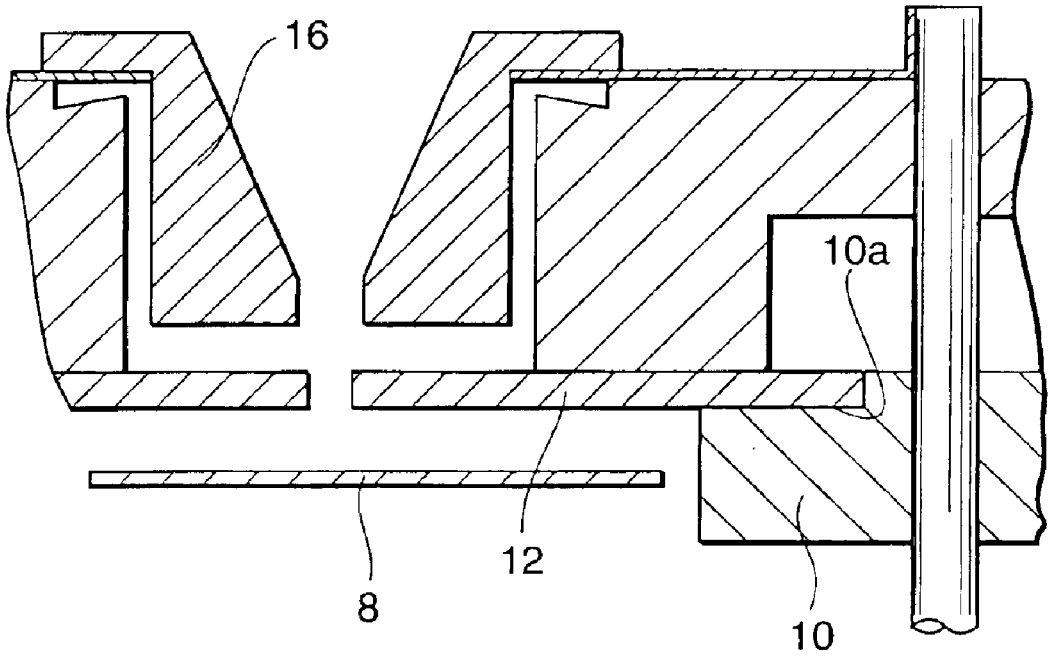
FIG. 10 is a sectional view showing another method for fixing the second discharge path limiting portion.

As shown in FIGS. 1, 2, and 6, the light-emitting portion assembly 6 comprises a disk-form electrical insulation portion (third support portion) 14 made of an electrically insulating ceramic. This third support portion 14 is disposed on the second support portion 10 so as to be superposed thereon, and is formed with an identical diameter to the second support portion 10. The second discharge path limiting plate 12 is fixed by being gripped between the lower face of the third support portion 14 and the upper face of the second support portion 10. Note that the seatability of the second discharge path limiting plate 12 may be improved by housing the second discharge path limiting plate 12 inside a concave portion 10*a* formed on the upper face of the second support portion 10 (see FIG. 10). Such a constitution is designed with a view to facilitating the assembly of the gas discharge tube 1 and ensures that the second discharge path limiting plate 12 is securely fixed within the hermetically sealed container 2.

A loading port 17 for loading a first discharge path limiting portion 16 made of a conductive metal (for example molybdenum, tungsten, or an alloy thereof) is formed in the center of the third support portion 14. A first opening 18 with a larger diameter than the second opening 13 is formed in the discharge path limiting portion 16 for narrowing the discharge path, and this first opening 18 is positioned on the same tube axis G as the second opening 13.

The first opening 18 comprises a funnel-shaped part 18*a* extending in the tube axis G direction for generating a favorable arc ball. This funnel-shaped part 18*a* narrows in diameter from the light exit window 4 toward the anode portion 8. More specifically, the funnel-shaped part 18*a* is formed with a 3.2 mm diameter on the light exit window 4 side and formed with an approximately 1 mm diameter on the anode portion 8 side such that the opening area thereof is larger than that of the second opening 13. Thus the discharge path is narrowed by the first opening 18 and second opening 13 in collaboration.

A conductive plate 19 is disposed in contact with the upper face of the third support portion 14, and an opening 19*a* formed in this conductive plate 19 aligns with the loading port 17, thereby enabling the first discharge path limiting portion 16 to be loaded. The conductive plate 19 is provided with two lead portions 19*b*, and each lead portion 19*b* is electrically connected to the respective distal end parts of discharge path limiting plate stem pins (third stem pins) 9C disposed in a standing position in the stem 5 (see FIGS. 2 and 7). A flange portion 16*a* provided on the first discharge path limiting portion 16 is disposed on the conductive plate 19 in contact therewith, and by welding the flange portion 16*a* to the conductive plate 19, the first discharge path limiting portion 16 and the conductive plate 19 are integrated.

Here, the first discharge path limiting portion 16 and second discharge path limiting portion 12 are separated by a space portion G in order to provide electrical insulation therebetween. The first discharge path limiting portion 16 and third support portion 14 are also separated in order to ensure this insulation. The reason for this is that when the first discharge path limiting portion 16 and second discharge path limiting portion 12 reach a high temperature during an operation of the lamp, sputtering material and evaporated material are generated from the first discharge path limiting portion 16 and second discharge path limiting portion 12, and metallic evaporated material at this time is actively caused to adhere to the wall face of the loading port 17. Hence, by separating the first discharge path limiting portion 16 and third support portion 14, the area to which metallic evaporated material is adhered increases, as a result of which a short-circuit between the first discharge path limiting portion 16 and second discharge path limiting portion 12 becomes unlikely.

Further, the wall face of the funnel-shaped part 18*a* is processed into a mirror surface. In this case, the wall face may be made into a mirror surface by polishing a simple material substance such as tungsten, molybdenum, palladium, nickel, titanium, gold, silver, or platinum (or an alloy thereof), or a mirror surface may be formed using this simple material substance or alloy as a base material, or using a ceramic as a base material, and applying a coating to the material by means of plating processing, vapor deposition processing, or similar. Thus the light emitted from an arc ball is reflected by the mirror surface of the funnel-shaped part 18*a* and condensed toward the light exit window 4, whereby the luminance of the light is increased.

Figure 8:
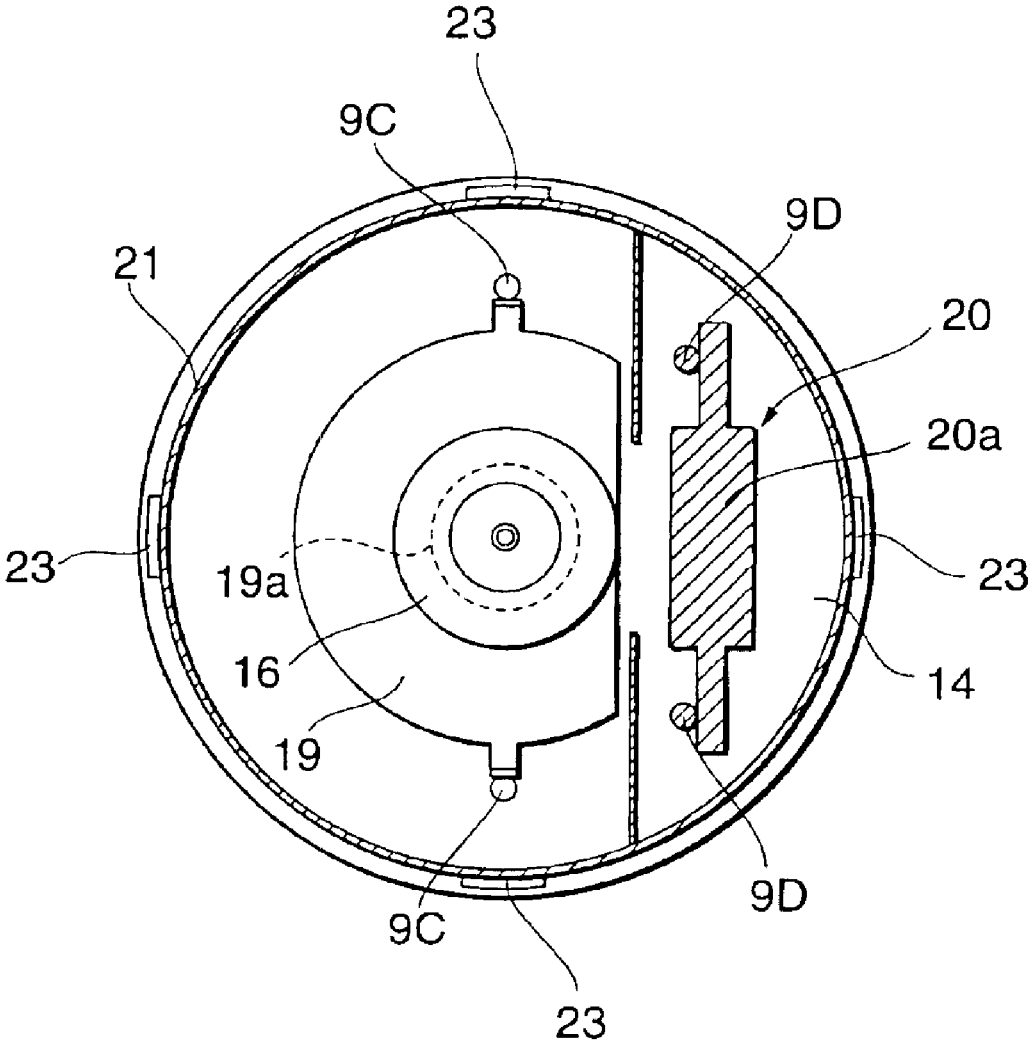
FIG. 8 is a sectional view along the III—III line in FIG. 1.

As shown in FIGS. 1 and 8, a cathode portion 20 is disposed in the light-emitting portion assembly 6 in a position removed from the optical path on the light exit window 4 side. The two ends of the cathode portion 20 are electrically connected to the respective distal end parts of cathode portion stem pins (second stem pins) 9D which are disposed in a standing position in the stem 5 so as to pass through the support portions 7, 10, 14. Thermoelectrons are generated by the cathode portion 20, or more specifically the cathode portion 20 is provided with a tungsten coil portion 20*a* which extends parallel to the light exit window 4 and generates thermoelectrons.

The cathode portion 20 is housed inside a cap-form metallic front cover 21. This front cover 21 is fixed by being bent following the insertion of a claw piece 21*a* provided thereon into a slit hole 23 provided in the third support portion 14. Further, a circular light transmitting port 21*b* is formed in the front cover 21 at the part which opposes the light exit window 4.

A discharge current plate 22 is provided inside the front cover 21 in a position removed from the optical path between the cathode portion 20 and first discharge path limiting portion 16. An electron-emitting window 22*a* of the discharge current plate 22 is formed as a rectangular opening for allowing the transmission of thermoelectrons.

Figure 7:
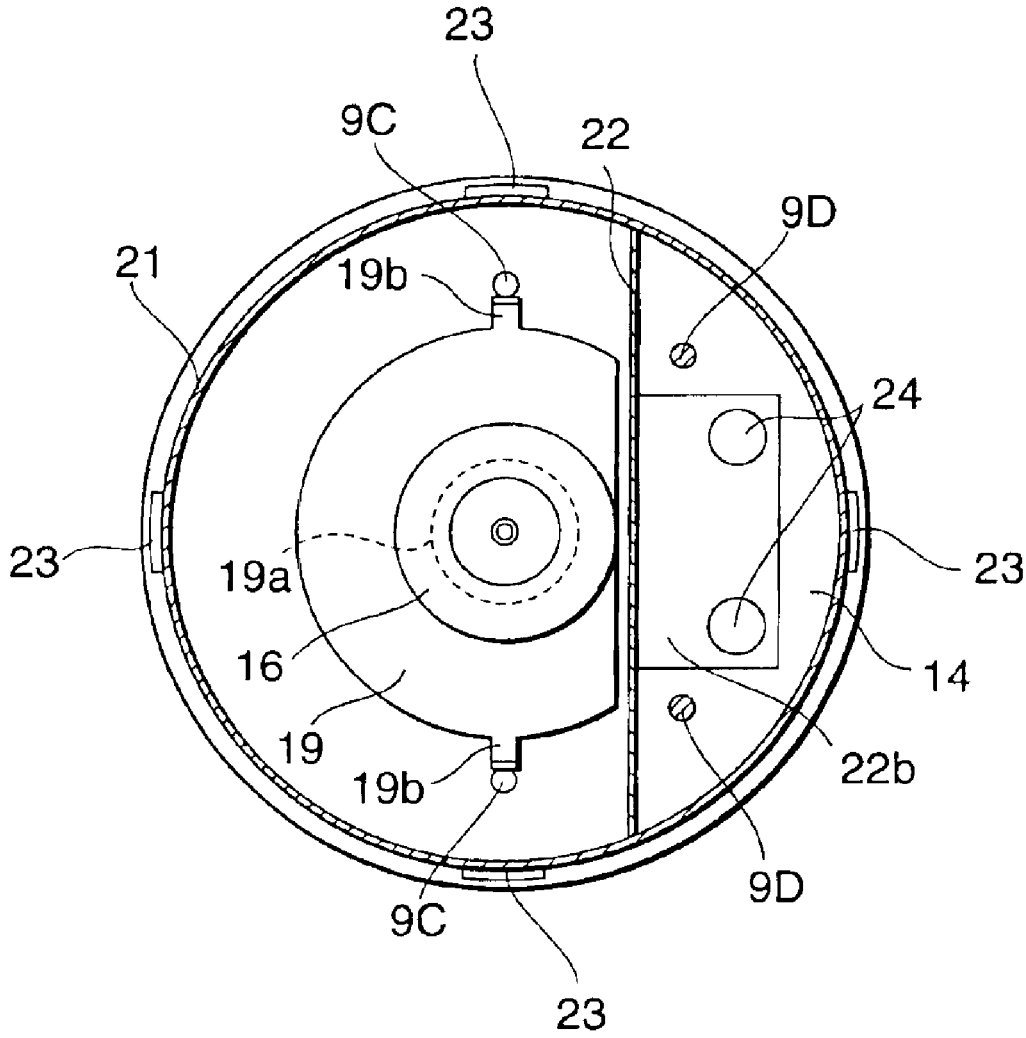
FIG. 7 is a sectional view along the II—II line in FIG. 1.

A leg piece 22*b* provided on the discharge current plate 22 is placed on the upper surface of the third support portion 14 and the discharge current plate 22 is fixed by driving in rivets 24 through the leg piece 22*b* toward the support portion 14 (see FIG. 7). Thus the cathode portion 20 is surrounded by the front cover 21 and discharge current plate 22 such that sputtering material or evaporated material emitted from the cathode portion 20 does not adhere to the light exit window 4.

The light-emitting portion assembly 6 constituted in this manner is provided within the hermetically sealed container 2, and since the interior of the hermetically sealed container 2 must be filled with deuterium gas at several hundred Pa, a glass exhaust pipe 26 is formed integrally with the stem 5 of the hermetically sealed container 2 in the center thereof. This exhaust pipe 26 is sealed by being fused at the end of the assembly process after the air inside the hermetically sealed container 2 has been removed and deuterium gas of a predetermined pressure has been appropriately filled therein. Note that a noble gas such as helium or neon may be sealed into the gas discharge tube 1 in other examples thereof.

Further, as shown in FIGS. 1 through 3, the eight stem pins 9A to 9D which are disposed in a standing position in the stem 5 are enveloped in ceramic electrical insulation tubes 27A to 27D so that the stem pins 9A to 9D are not exposed between the stem 5 and the support portion 7. Thus electrical discharge between the stem pins 9A to 9D is prevented. Further, the distal ends of the tubes 27A, 27B, 27C are inserted into the first support portion 7 from the lower face side so as to support the first support portion 7 from below, and the tube 27D is inserted into the third support portion 14 from the lower face side so as to support the third support portion 14 from below. Thus the light-emitting portion assembly 6 is also supported by the tubes 27A to 27D, thereby contributing to an improvement in the vibration resistance quality of the lamp.

This type of gas discharge tube 1 is constructed to precipitate high luminance, and thus further reductions in the area of the openings 18, 13 in the first and second discharge path limiting portions 16, 12 can be made easily while maintaining favorable startability and without drastically raising the start-up voltage of the lamp. Moreover, the eight stem pins 9A to 9D are disposed in the gas discharge tube 1 in a standing position in the stem 5, thus enabling power to be supplied to each component within the light-emitting portion assembly 6 while simultaneously facilitating support of the light-emitting portion assembly 6. Thus it becomes easy to create a floating structure for the light-emitting portion assembly 6 inside the hermetically sealed container 2.

Next an operation of the head-on type deuterium discharge tube 1 described above will be described.

First electric power of approximately 10 W is supplied to the cathode portion 20 from an external power source via the stem pins 9D for up to twenty seconds prior to discharge in order to preheat the coil portion 20*a* of the cathode portion 20. Then a voltage of approximately 160V is applied between the cathode portion 20 and anode portion 8, thereby completing the preparation for arc discharge.

Once this preparation is complete, trigger voltages of approximately 100V and approximately 120V are applied from an external power source to the first discharge path limiting portion 16 via the stem pins 9C and to the second discharge path limiting portion 12 via the stem pins 9B respectively. As a result, electrical discharge is generated in succession between the cathode portion 20 and first discharge path limiting portion 16, between the cathode portion 20 and second discharge path limiting plate 12, and between the cathode portion 20 and anode portion 8.

When different voltages are applied to the first discharge path limiting portion 16 and second discharge path limiting plate 12 in this manner, an electric field is produced between the first discharge path limiting portion 16 and second discharge path limiting plate 12, and thus electrons can be actively moved from the vicinity of the first discharge path limiting portion 16 to the second discharge path limiting plate 12. By actively generating this type of gradual discharge, a secure starting discharge is generated between the cathode portion 20 and anode portion 8 even when the discharge path is narrowed by the opening 18 having a diameter of 0.2 mm, for example.

When such a starting discharge is generated, arc discharge is maintained between the cathode portion 20 and anode portion 8 and arc balls are generated respectively in the openings 13, 18 which narrow the discharge path. Ultraviolet rays emitted from these arc balls then pass through the light exit window 4 as extremely high luminance light and are discharged to the outside. It has been confirmed experientially that luminance is almost six times higher in the deuterium lamp 1 described above than in a conventional deuterium lamp having a 1 mm diameter opening.

Other embodiments of the gas discharge tube will now be described. Note that the following descriptions are limited to substantial differences with the first embodiment, and that identical or similar constitutional components to the first embodiment have been allocated identical reference symbols and explanation thereof omitted.

(Second Embodiment)

Figure 11:
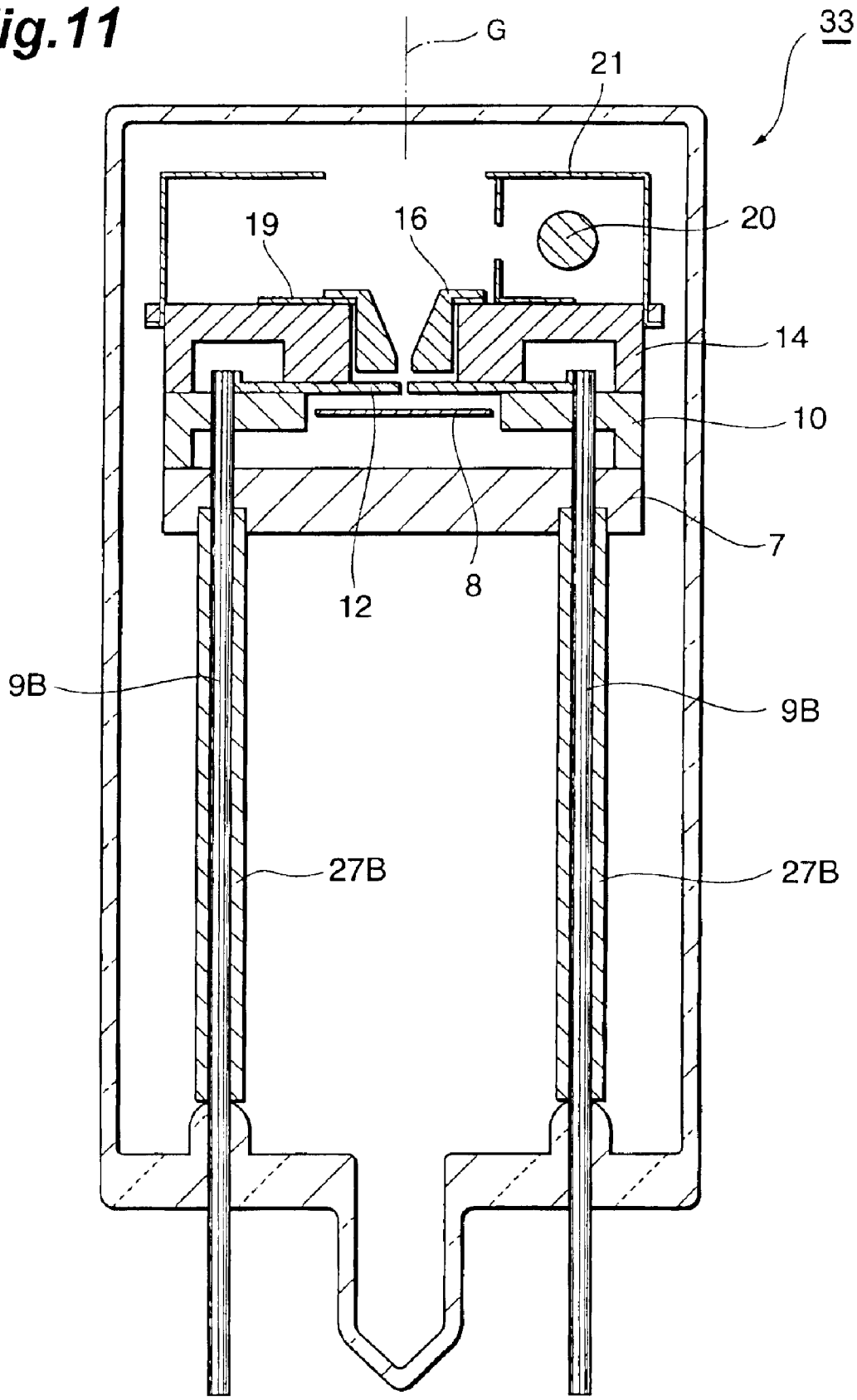
FIG. 11 is a sectional view showing a second embodiment of a gas discharge tube.
Figure 12:
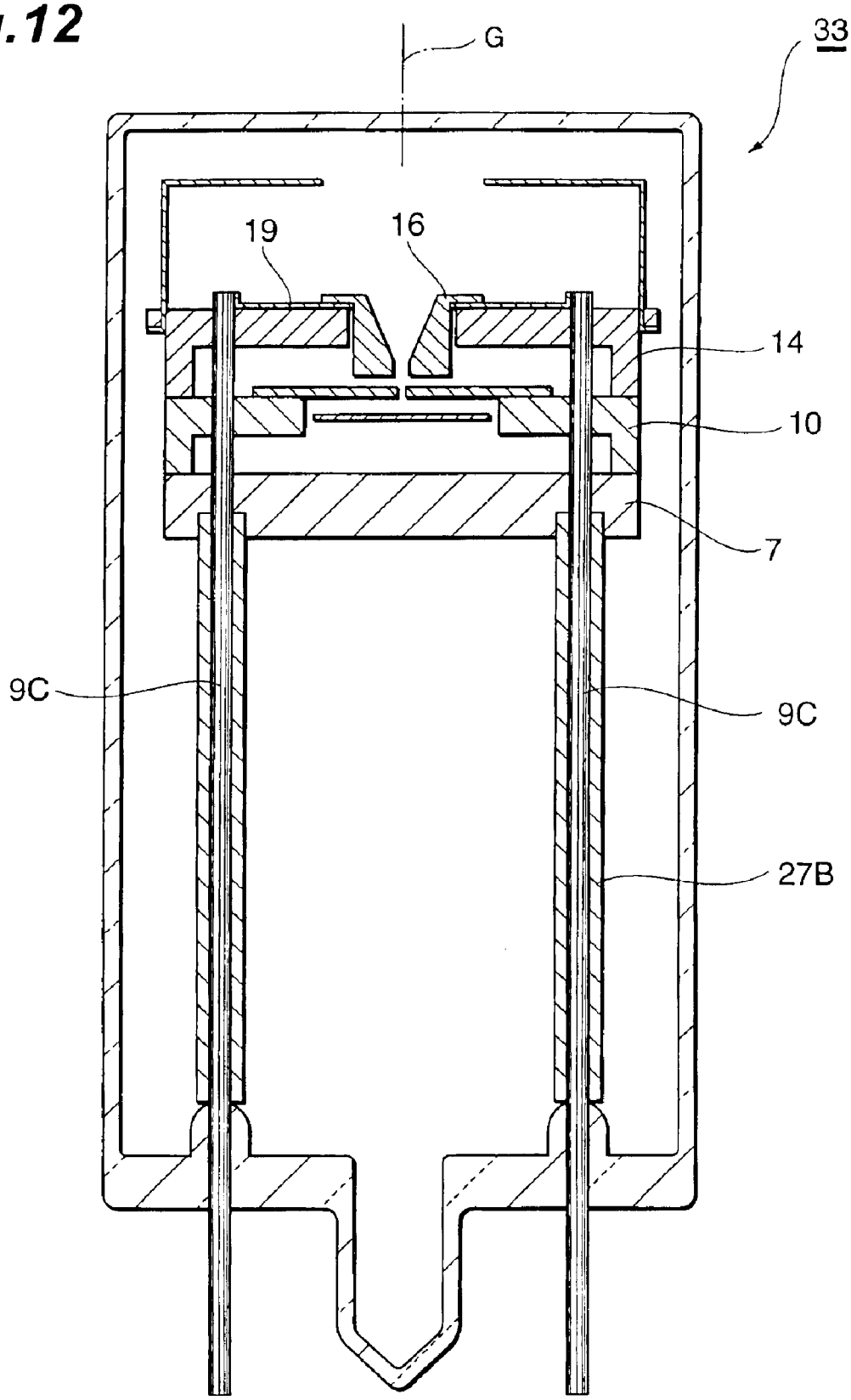
FIG. 12 is a sectional view of the gas discharge tube shown in FIG. 11.

As shown in FIGS. 11 and 12, in a gas discharge tube 33 a second discharge path limiting plate 12 is not fixed by being gripped between a second support portion 10 and a third support portion 14, but instead the second discharge path limiting plate 12 is merely welded to the distal end of stem pins 9B and placed on the second support portion 10. Hence heat discharge from a first discharge path limiting portion 16 and the second discharge path limiting plate 12 can be increased and the amount of sputtering material and evaporated material generated by the first discharge path limiting portion 16 and second discharge path limiting plate 12 can be reduced. As a result the lamp characteristic can be maintained in a stable state over a long time period.

(Third Embodiment)

Figure 13:
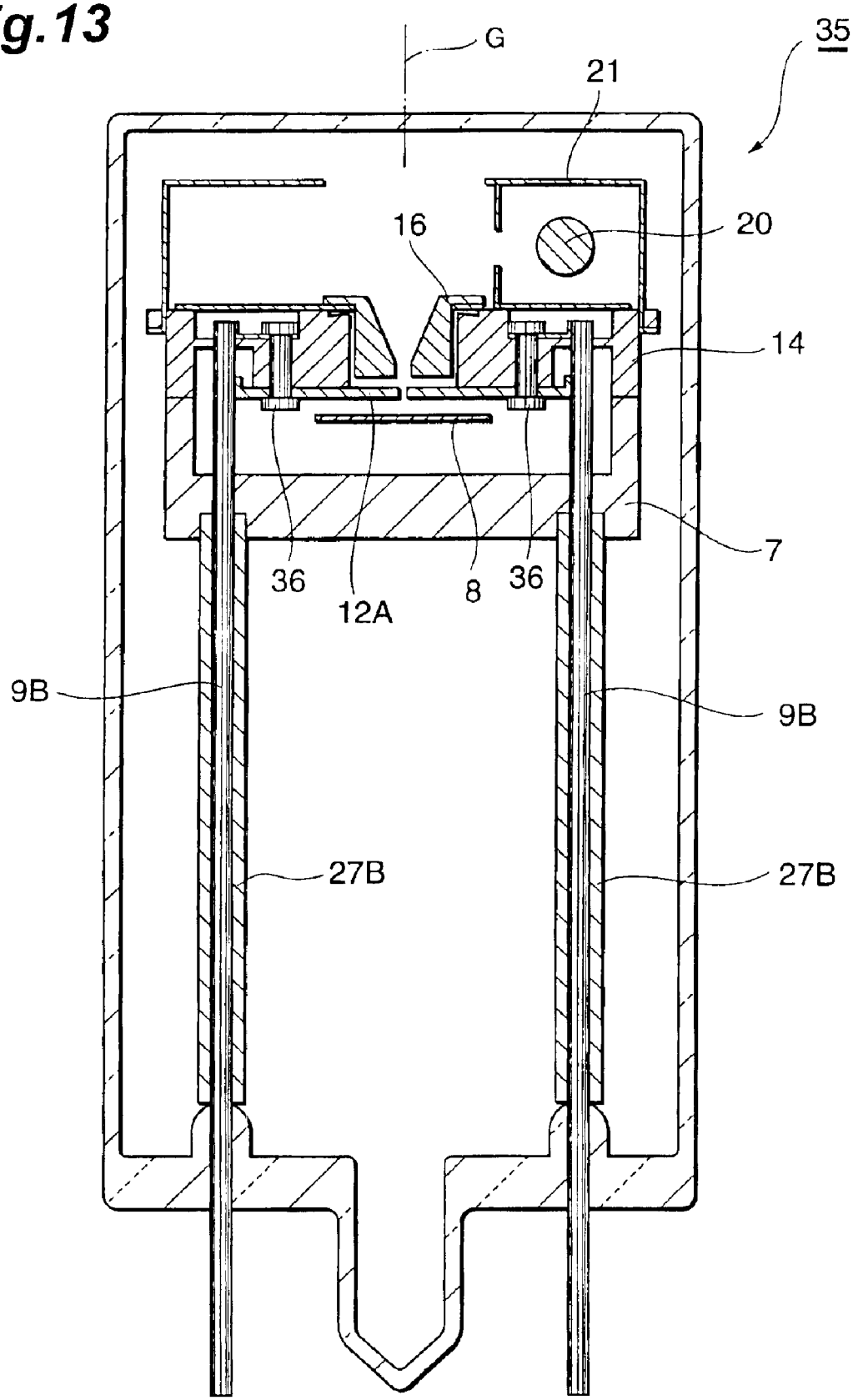
FIG. 13 is a sectional view showing a third embodiment of a gas discharge tube.
Figure 14:
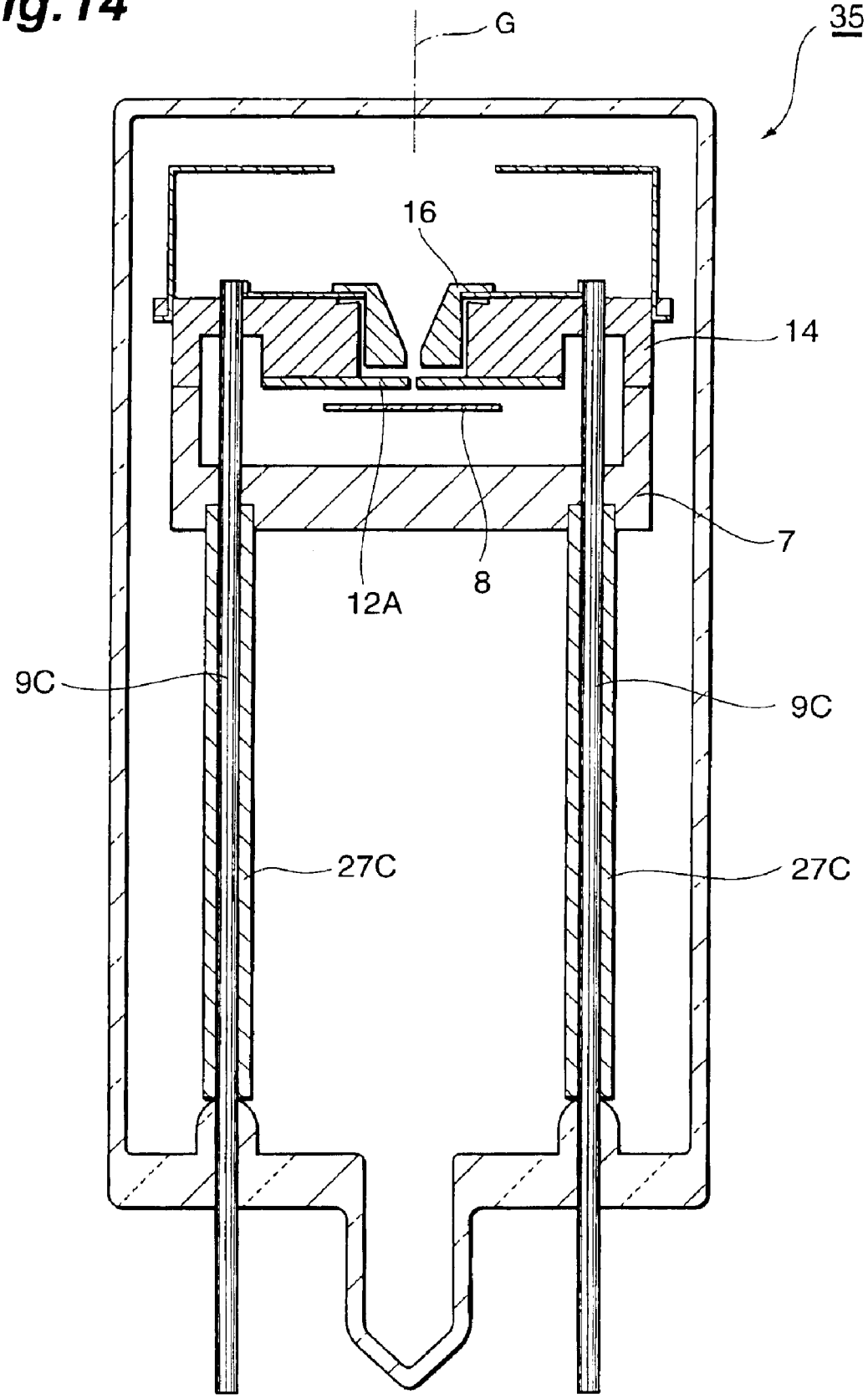
FIG. 14 is a sectional view of the gas discharge tube shown in FIG. 13.

As shown in FIGS. 13 and 14, in a gas discharge tube 35 a second discharge path limiting plate 12A is disposed in contact with the rear face of an electrical insulation portion (third support portion) 14, and the second discharge path limiting plate 12A is fixed to the electrical insulation portion 14 by metallic rivets 36. Thus the electrical insulation portion 14 and second discharge path limiting plate 12A are integrated. During an assembly operation the rivets 36 are electrically connected to the distal ends of stem pins 9B. By means of such a constitution the ceramic second support portion 10 can be omitted, thereby reducing the number of support portions from three to two. Moreover, heat discharge from the second discharge path limiting plate 12A and anode portion 8 can be increased, and thus the amount of sputtering material and evaporated material generated by the second discharge path limiting plate 12A and anode portion 8 can be reduced. As a result the lamp characteristic can be maintained in a stable state over a long time period.

(Fourth Embodiment)

Figure 15:
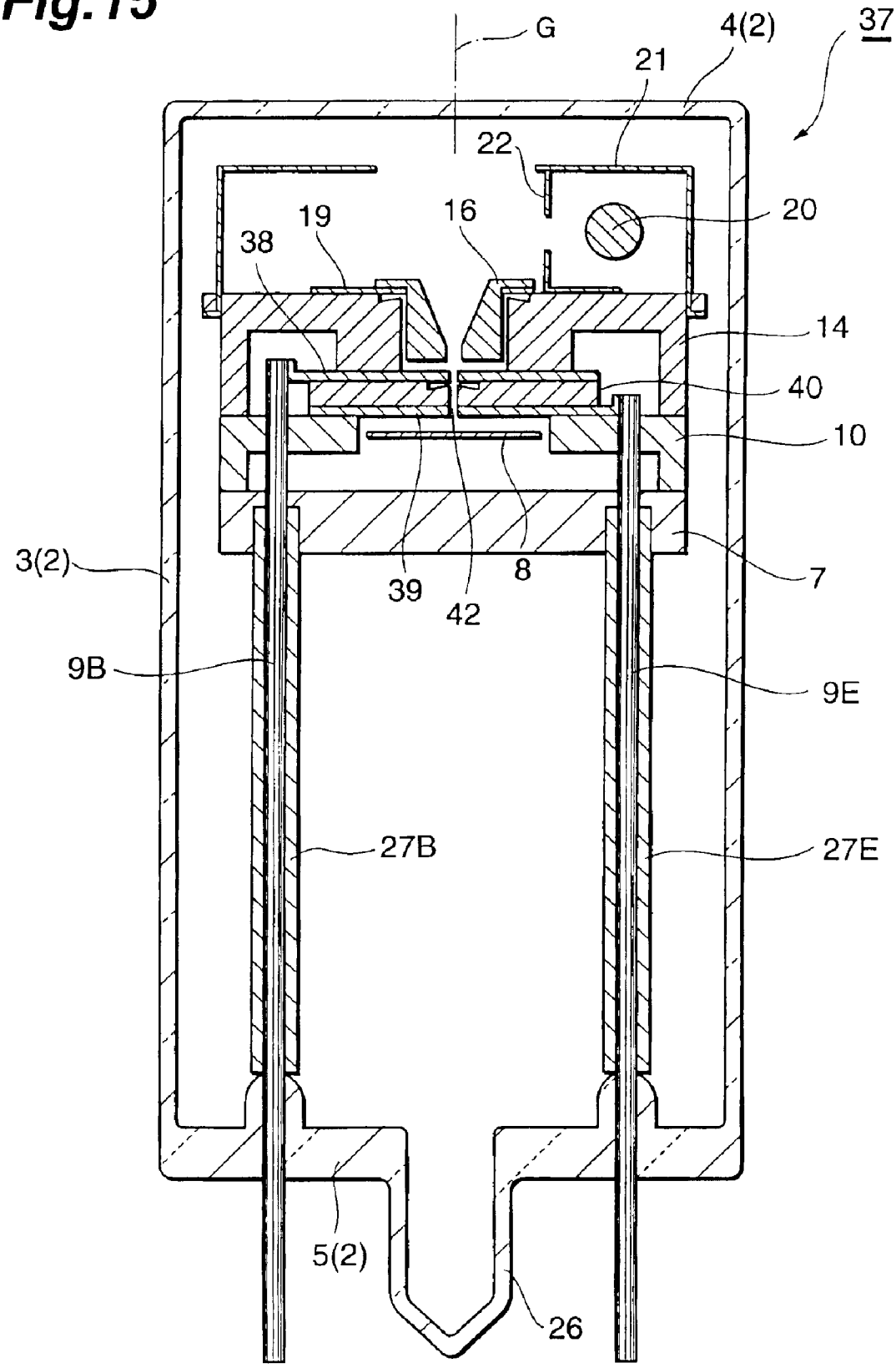
FIG. 15 is a sectional view showing a fourth embodiment of a gas discharge tube.
Figure 16:
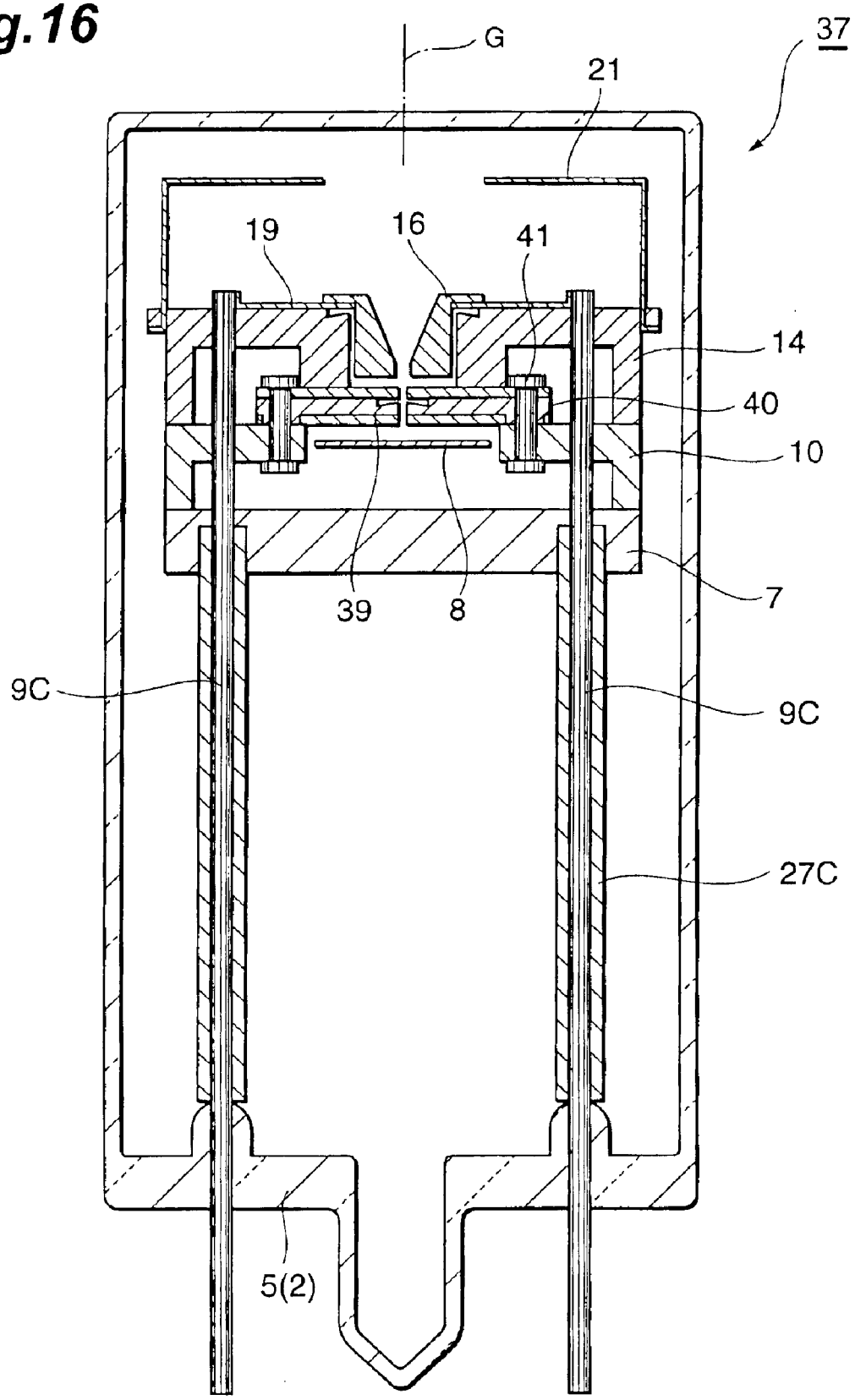
FIG. 16 is a sectional view of the gas discharge tube shown in FIG. 15.
Figure 17:
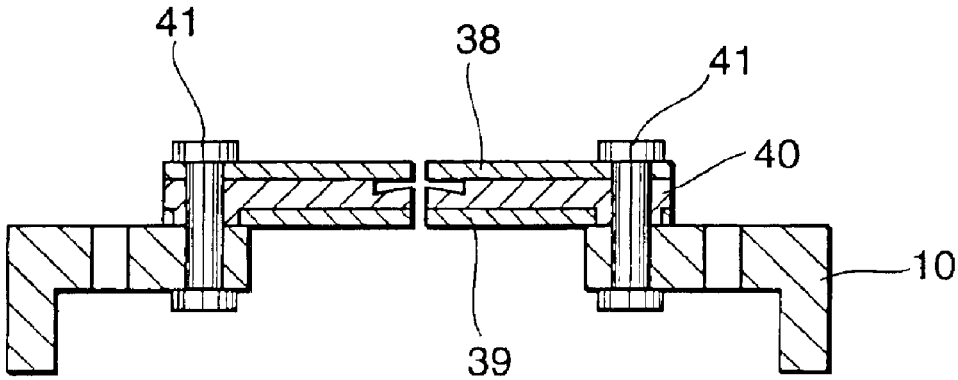
FIG. 17 is an enlarged sectional view of the main parts of the gas discharge tube shown in FIG. 16.

As shown in FIGS. 15, 16, and 17, in a gas discharge tube 37 electrical insulation is achieved between a disk-form second discharge path limiting portion 38 and a disk-form third discharge path limiting portion 39 by interposing a disk-form ceramic spacer 40. The spacer 40 is fixed to a second support portion 10 by a metallic rivet 41. The second discharge path limiting portion 38, third discharge path limiting portion 39, and spacer 40 are fixed by being gripped between the second support portion and a third support portion 14.

Figure 18:
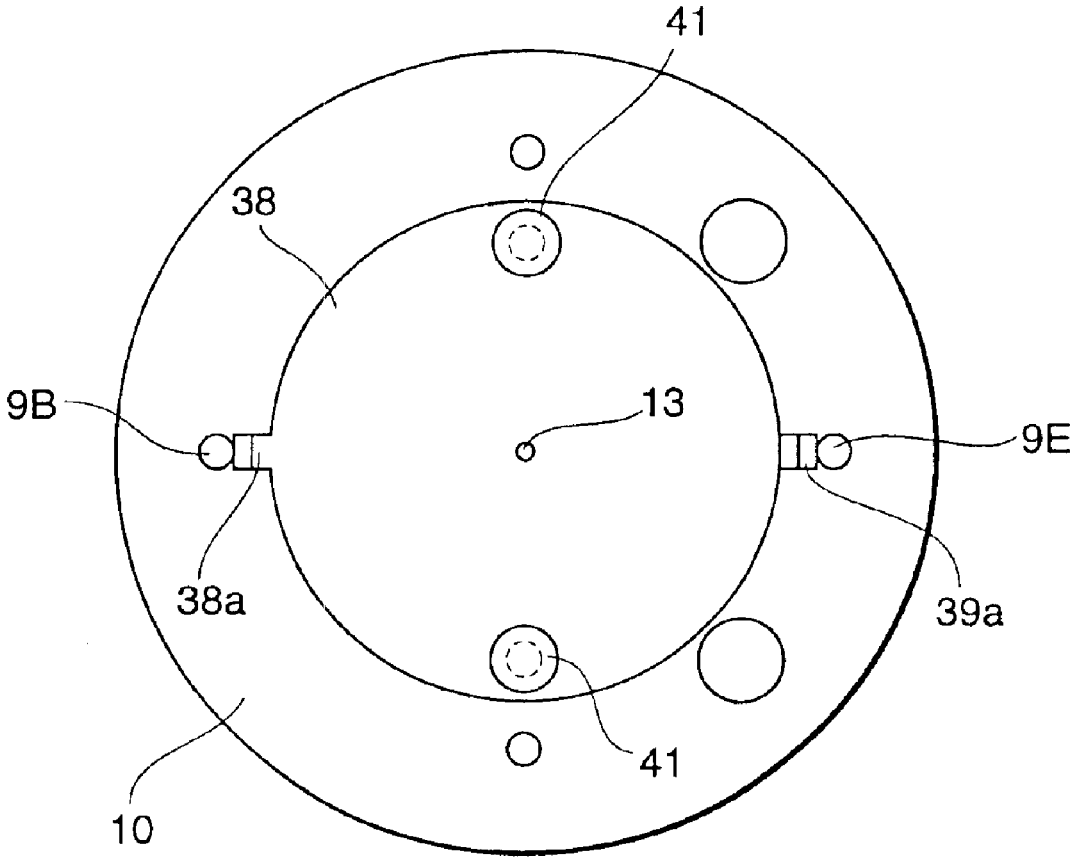
FIG. 18 is a plan view of FIG. 17.

Further, as shown in FIGS. 15 and 18, the second discharge path limiting portion 38 is electrically connected via a lead portion 38*a* to the distal end of a fourth stem pin 9B disposed in a standing position in the stem 5 so that different potentials can be applied to the second discharge path limiting portion 38 and third discharge path limiting portion 39. The third discharge path limiting portion 39, on the other hand, is electrically connected via a lead portion 39*a* to the distal end part of a fifth stem pin 9E which is disposed in a standing position in the stem 5. Note that the symbol 27E refers to an electrical insulation tube which protects the stem pin 9E. A larger voltage is applied to the third discharge path limiting portion 39 than to the second discharge path limiting portion 38.

For example, when 140V are applied to the third discharge path limiting portion 39, 120V are applied to the second discharge path limiting portion 38 and 100V are applied to a first discharge path limiting portion 16. By applying different voltages to the first discharge path limiting portion 16, second discharge path limiting portion 38, and third discharge path limiting portion 39 in this manner, an electric field is generated between the first discharge path limiting portion 16 and third discharge path limiting portion 39, whereby the movement of electrons in the vicinity of the first discharge path limiting portion 16 to the second discharge path limiting portion 38 and third discharge path limiting portion 39 can be actively performed.

A third opening 42 is formed in the center of the third discharge path limiting portion 39 for narrowing the discharge path. This third opening 42 may have either an identical or a different diameter to that of the second opening 13 of the second discharge path limiting portion 38. If, for example, the third opening 42 is formed at 0.1 mm while the second opening 13 is 0.3 mm, the discharge path can be further narrowed such that even higher luminance is achieved.

Figure 19:
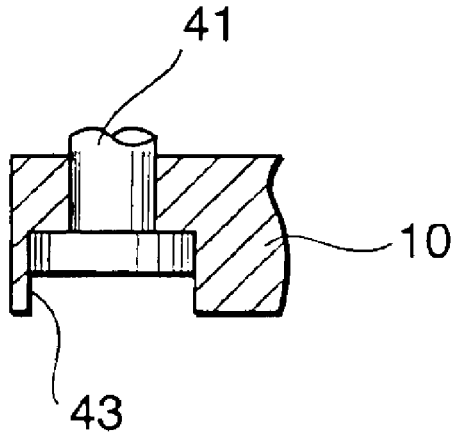
FIG. 19 is a sectional view showing another example of a fixing method using a rivet.

Note that when the rivet 41 reaches a high temperature during an operation of the lamp, sputtering material and evaporated material is generated from the head part of the rivet 41. Hence by housing the end portion of the rivet 41 inside a concave portion 43 provided in the second support portion 10 as shown in FIG. 19, the area of adhesion of metallic evaporated material is increased, whereby a short-circuit between the second discharge path limiting portion 38 and third discharge path limiting portion 39 through which the rivet 41 is disposed becomes unlikely.

Figure 20:
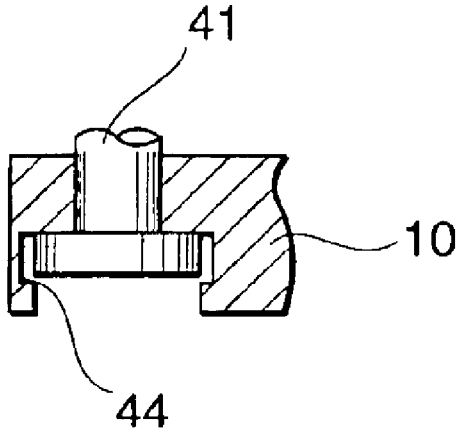
FIG. 20 is a sectional view showing a further example of a fixing method using a rivet.
Figure 21:
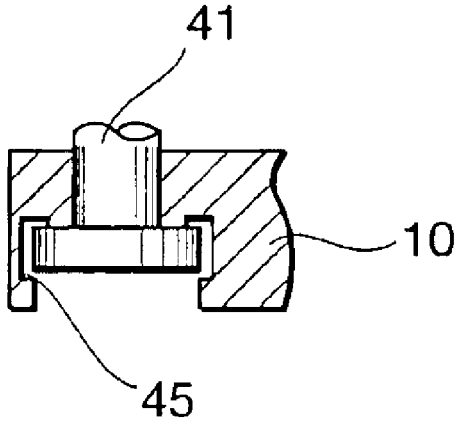
FIG. 21 is a sectional view showing a further example of a fixing method using a rivet.

Further, as shown in FIG. 20, a concave portion 44 which increases the housing volume for the head part of the rivet 41 is formed in the second support portion 10. As shown in FIG. 21, a concave portion 45 which achieves a further increase in the housing volume for the head part of the rivet 41 is formed in the second support portion 10, and in this case the wall face of the concave portion 45 is maximally removed from the head part.

(Fifth Embodiment)

Figure 22:
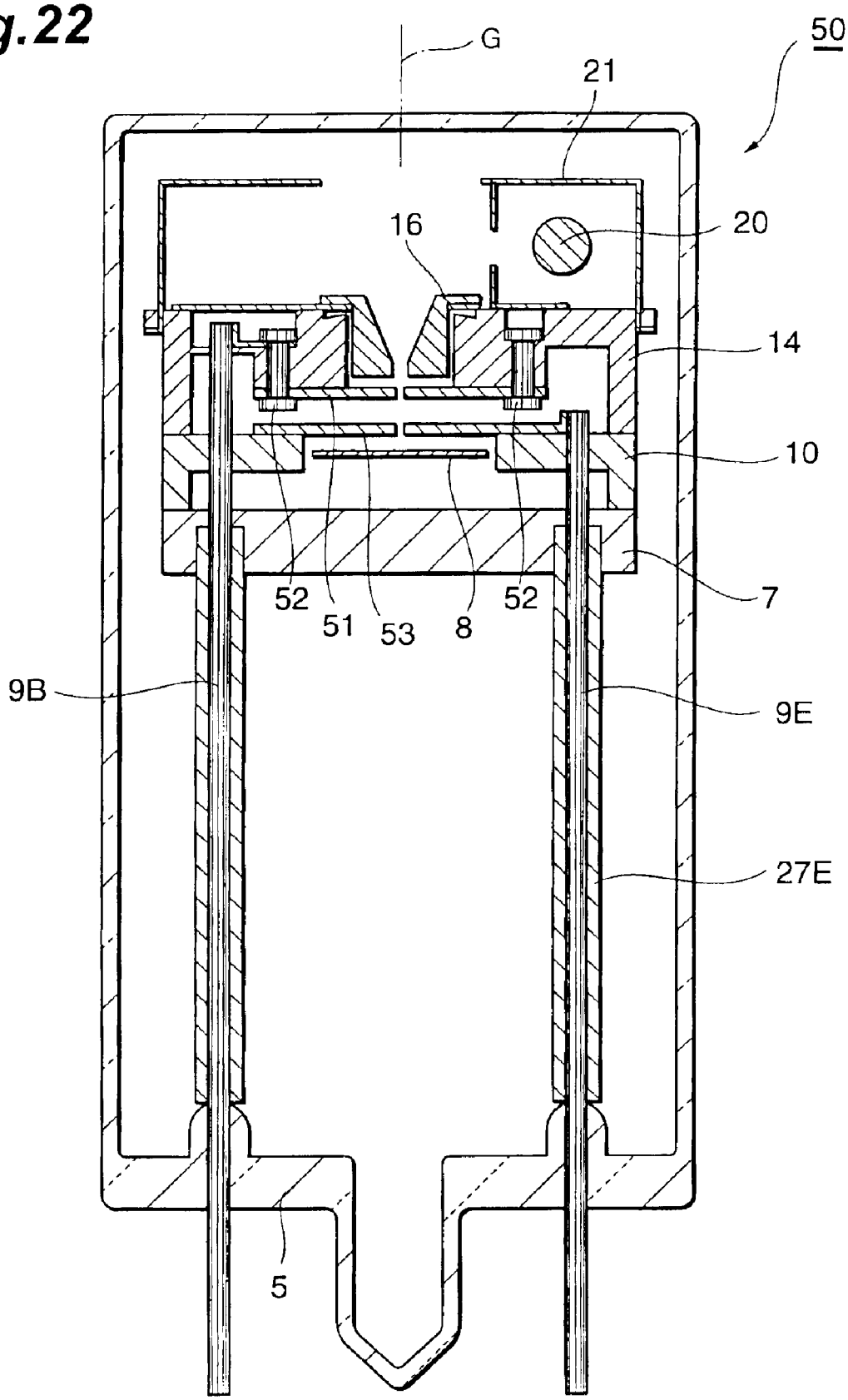
FIG. 22 is a sectional view showing a fifth embodiment of a gas discharge tube.
Figure 23:
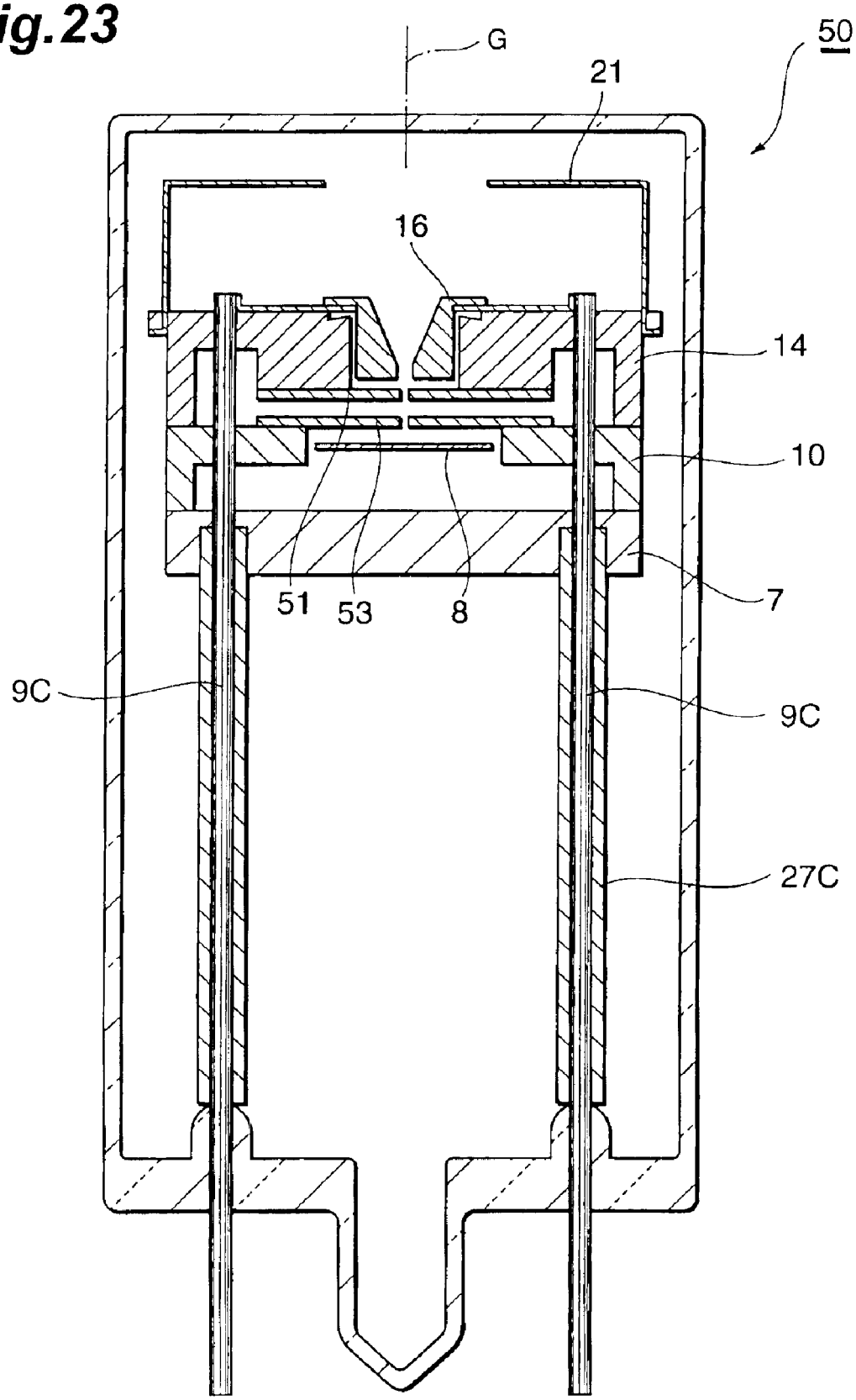
FIG. 23 is a sectional view of the gas discharge tube shown in FIG. 22.

As shown in FIGS. 22 and 23, in a gas discharge tube 50 a second discharge path limiting plate 51 is disposed in contact with the rear face of an electrical insulation portion (third support portion) 14, and the second discharge path limiting portion 51 is fixed to the electrical insulation portion 14 by a metallic rivet 52. Thus the electrical insulation portion 14 and second discharge path limiting plate 51 are integrated. Further, a third discharge path limiting portion 53 is disposed in contact with the upper face of a second support portion 10, and the second discharge path limiting portion 51 and third discharge path limiting portion 53 are separated by a space. The second discharge path limiting portion 51 is electrically connected to a fourth stem pin 9B via a rivet 52, and the third discharge path limiting portion 53 is electrically connected to the distal end part of a fifth stem pin 9E which is disposed in a standing position in the stem 5.

(Sixth Embodiment)

Figure 24:
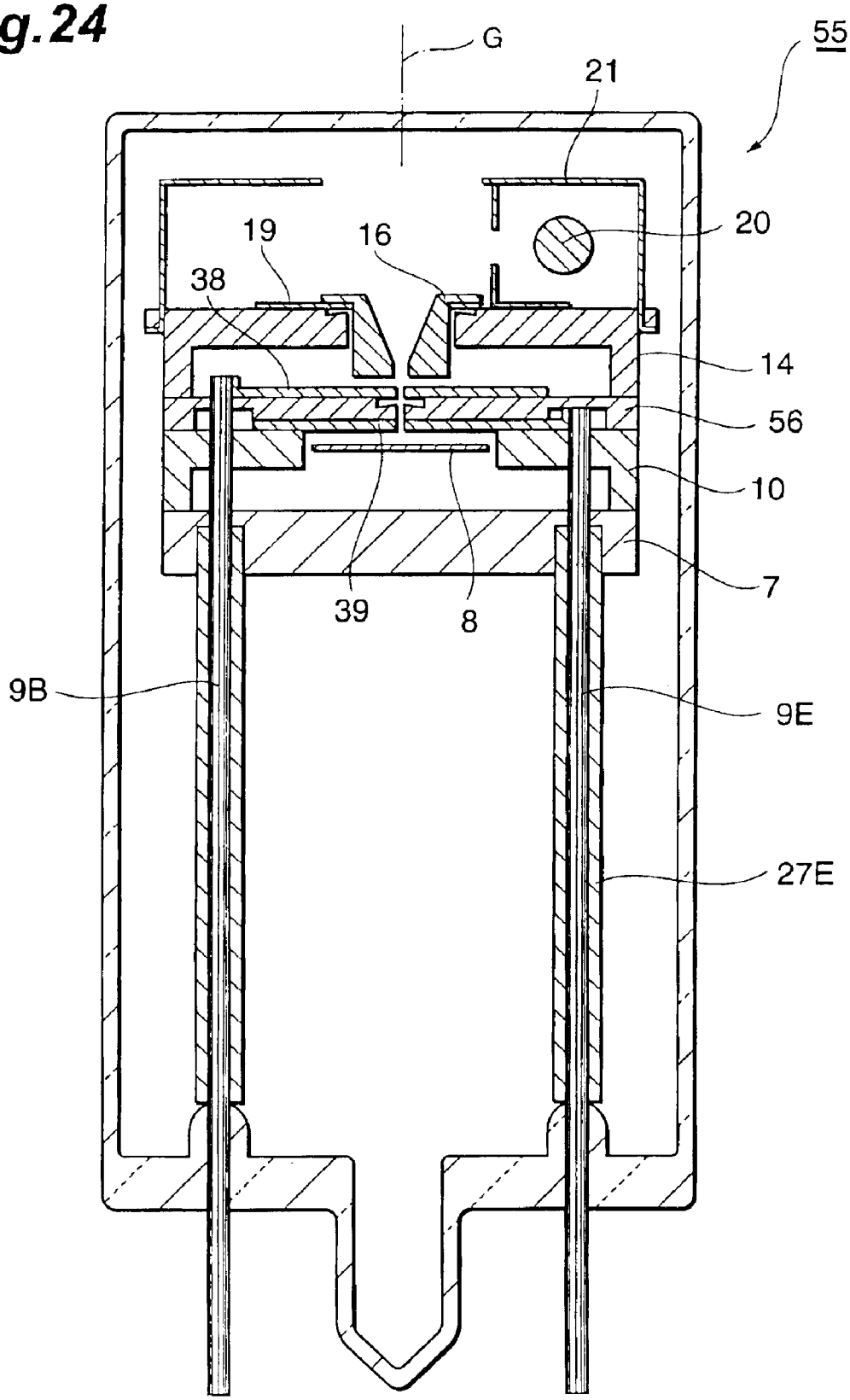
FIG. 24 is a sectional view showing a sixth embodiment of a gas discharge tube.
Figure 25:
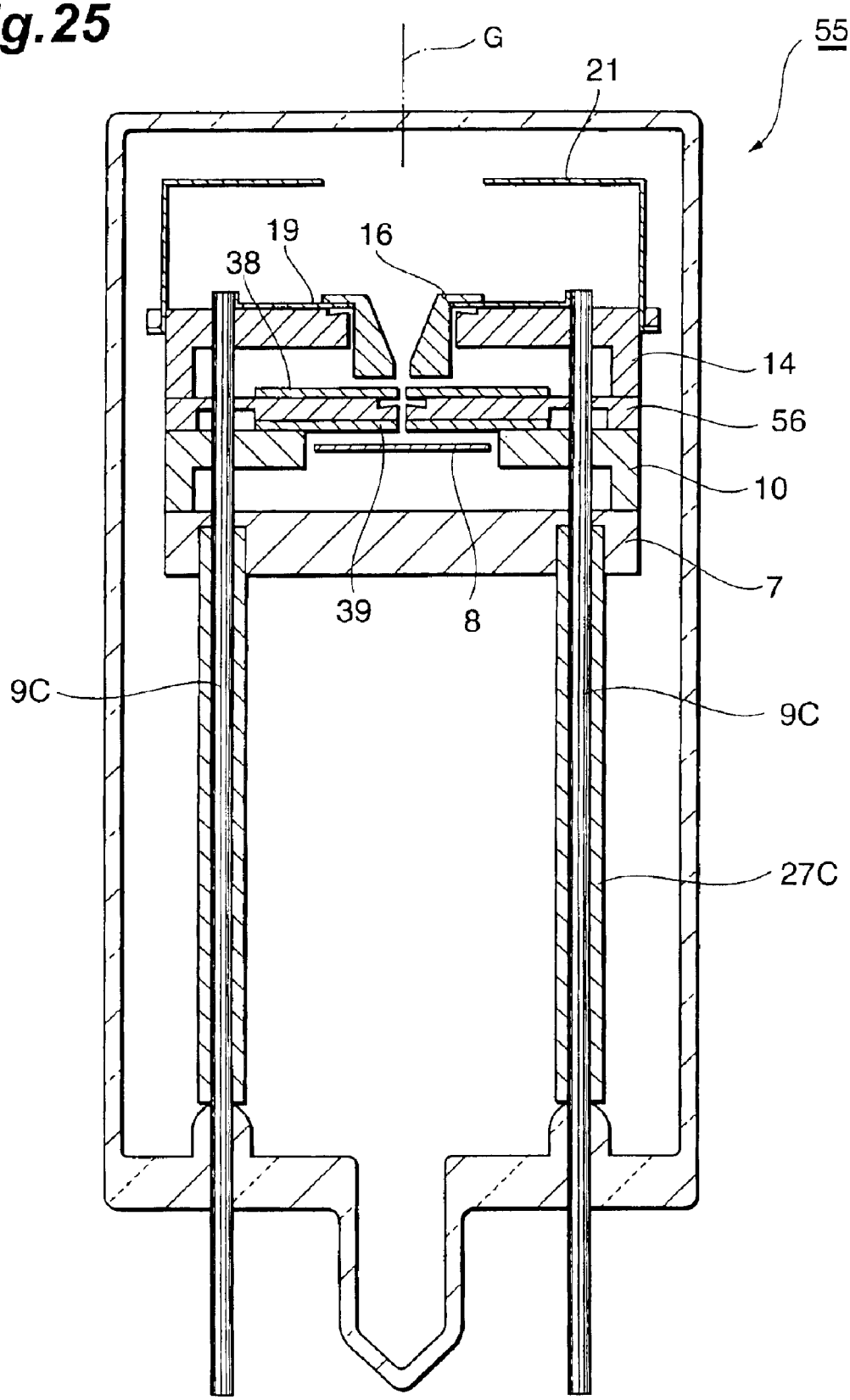
FIG. 25 is a sectional view of the gas discharge tube shown in FIG. 24.

As shown in FIGS. 24 and 25, in a gas discharge tube 55 a disk-form ceramic spacer 56 is gripped between a second support portion 10 and a third support portion 14. A second discharge path limiting portion 38 is disposed in contact with the upper face of the spacer 56 and a third discharge path limiting portion 39 is disposed in contact with the rear face thereof. The third discharge path limiting portion 39 is fixed by being gripped between the spacer 56 and second support portion 10. If such a constitution is employed, then the spacer 56 does not have to be fixed to the second support portion 10 using a rivet or the like.

(Seventh Embodiment)

Figure 26:
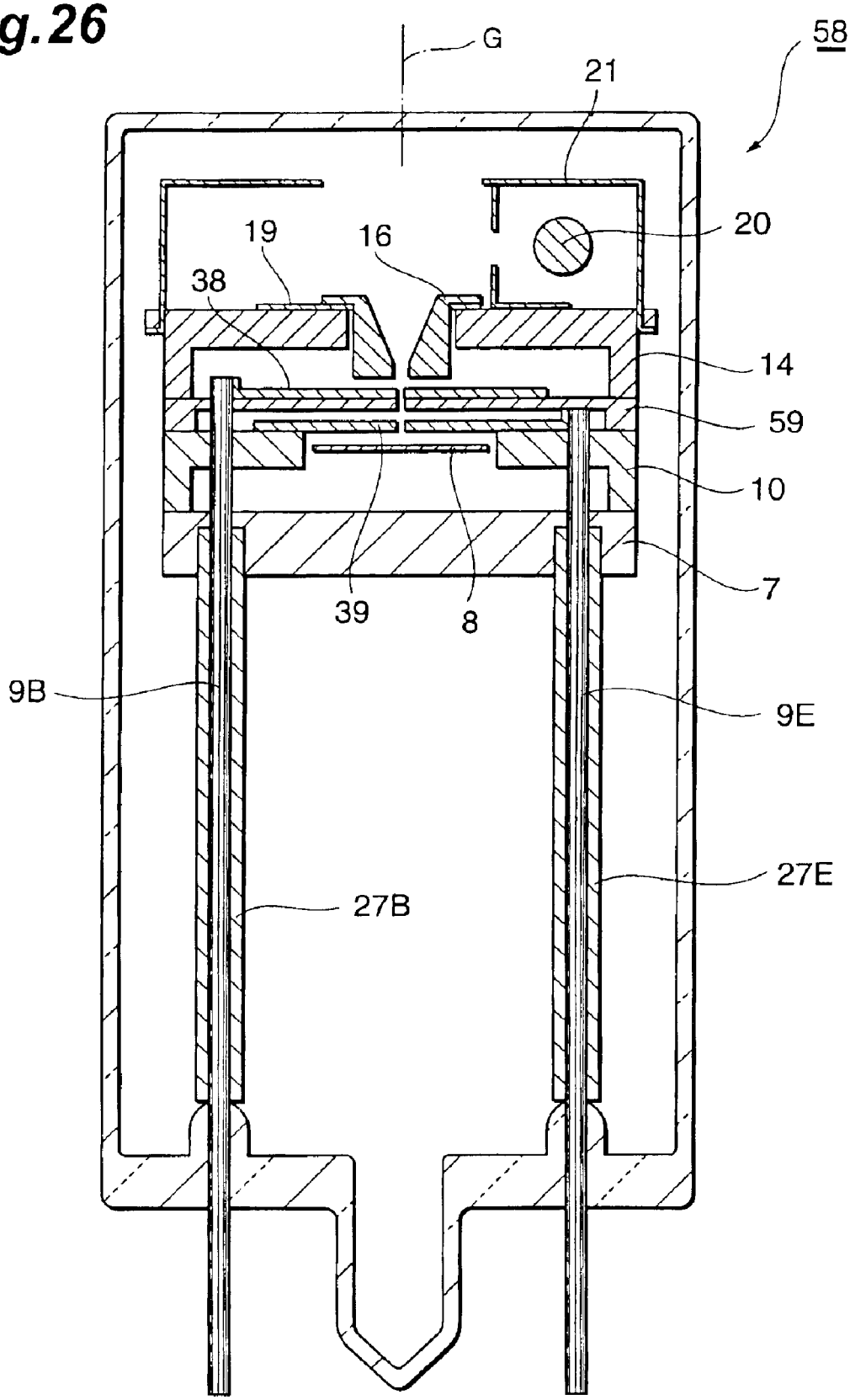
FIG. 26 is a sectional view showing a seventh embodiment of a gas discharge tube.
Figure 27:
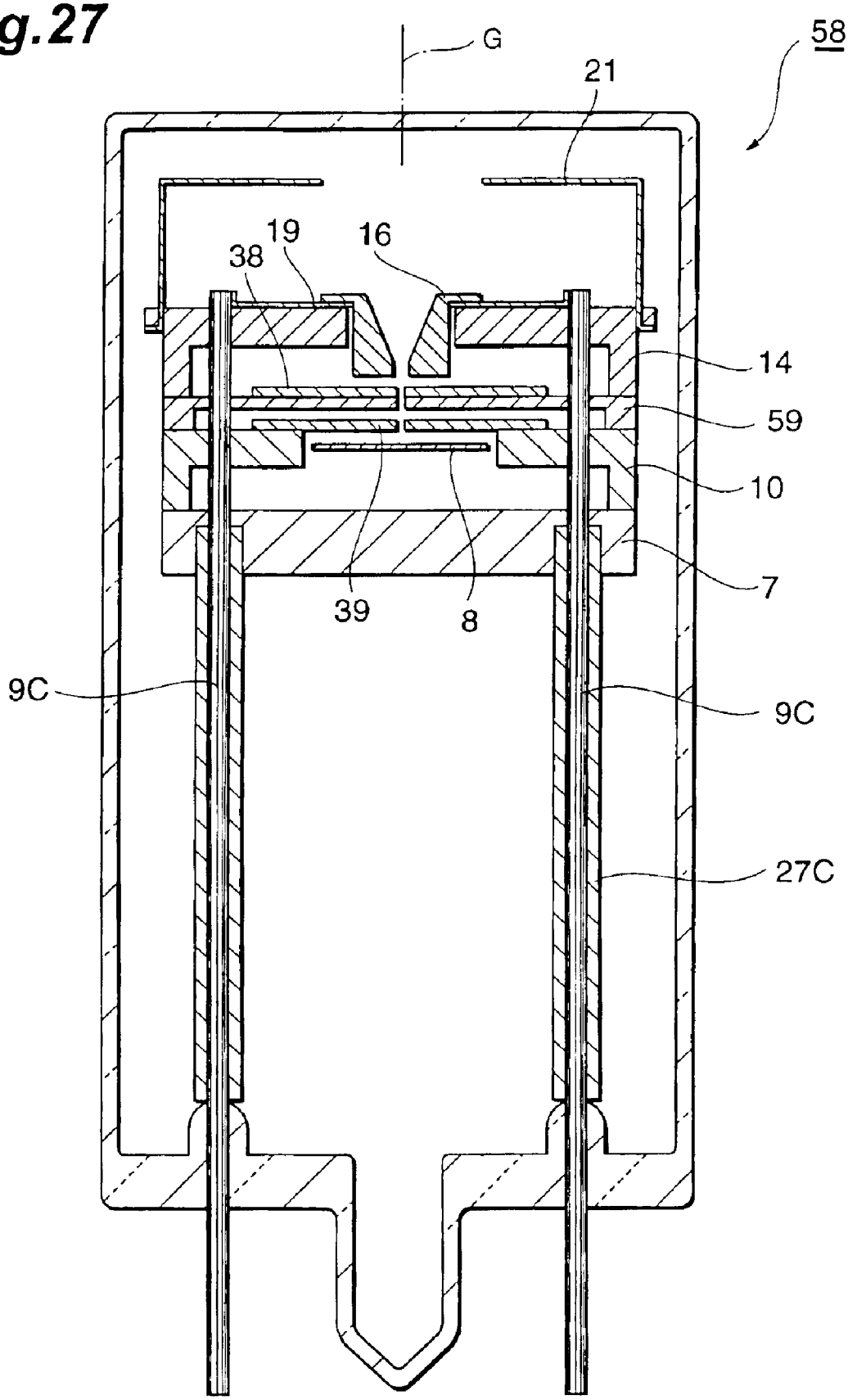
FIG. 27 is a sectional view of the gas discharge tube shown in FIG. 26.

As shown in FIGS. 26 and 27, in a gas discharge tube 58 a disk-form ceramic spacer 59 is gripped between a second support portion 10 and a third support portion 14. A second discharge path limiting portion 38 is disposed in contact with the upper face of the spacer 59 and a third discharge path limiting portion 39 is disposed in contact with the upper face of the second support portion 10. As a result, the second discharge path limiting portion 38 and third discharge path limiting portion 39 are separated by a space and the spacer 59, and the spacer 59 does not have to be fixed to the second support portion 10 using a rivet or the like.

(Eighth Embodiment)

Figure 28:
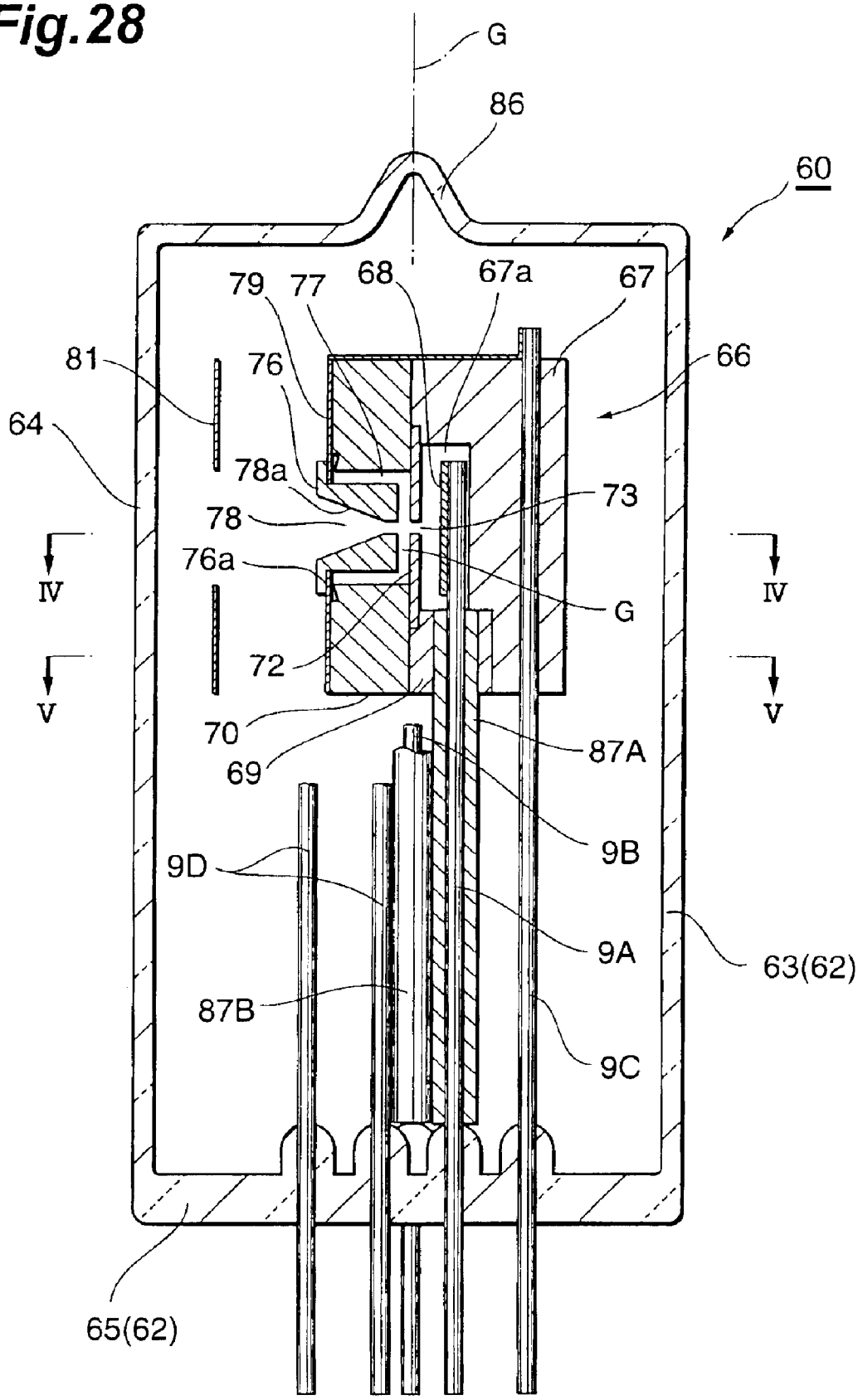
FIG. 28 is a sectional view showing an eighth embodiment of a gas discharge tube.
Figure 29:
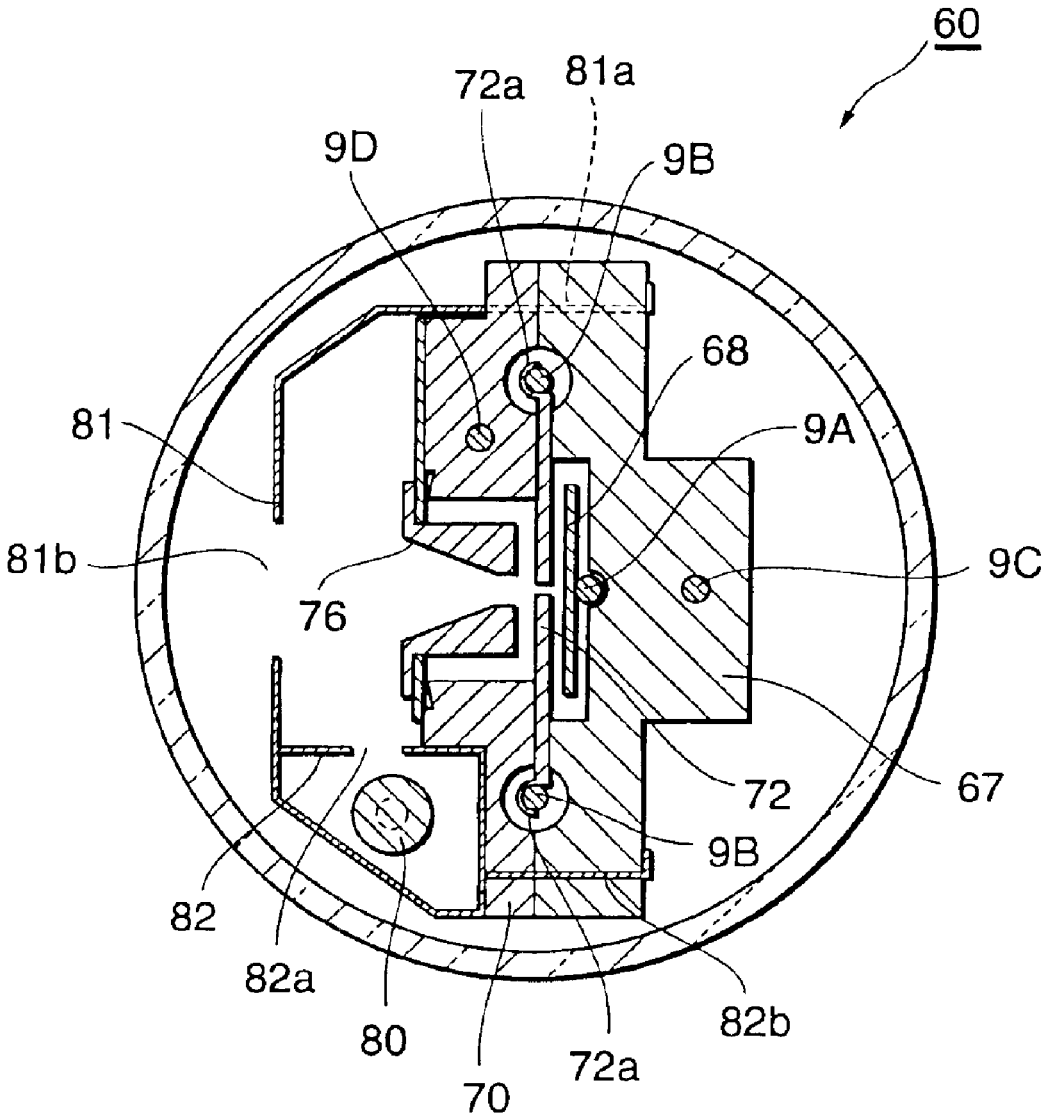
FIG. 29 is a sectional view along the IV—IV line in FIG. 28.

A gas discharge tube 60 shown in FIGS. 28 and 29 is a side-on type deuterium lamp. This discharge tube 60 is provided with a glass hermetically sealed container 62 into which deuterium gas is sealed at approximately several hundred Pa. The hermetically sealed container 62 is constituted by a cylindrical side tube 63 which seals one end side thereof and a stem 65 which seals the other end side of the side tube 63. A part of the side tube 63 is used as a light exit window 64. A light-emitting portion assembly 66 is housed inside the hermetically sealed container 62.

The light-emitting portion assembly 66 comprises an electrical insulation portion (first support portion) 67 made of an electrically insulating ceramic. An anode plate (anode portion) 68 is housed inside a concave portion 67*a* formed in the front face of the electrical insulation portion 67. The distal end part of an anode stem pin (first stem pin) 9A which is disposed in a standing position in the stem 65 so as to extend in the direction of the tube axis G is electrically connected to the back face of the anode plate 68. A ceramic loading portion 69 through which the first stem pin 9A passes is fitted into the first support portion 67.

The light-emitting portion assembly 66 further comprises an electrical insulation portion (second support portion) 70 made of an electrically insulating ceramic. This second support portion 70 is fixed so as to be superposed on the first support portion 67 in a perpendicular direction to the tube axis G. A plate-form second discharge path limiting portion 72 is fixed by being gripped between the front face of the first support portion 67 and the back face of the second support portion 70 such that the second discharge path limiting portion 72 and anode plate 68 oppose each other.

A small hole (second opening) 73 with a diameter of 0.2 mm is formed in the center of the second discharge path limiting portion 72 for narrowing the discharge path. Two lead portions 72*a* are provided on the left and right side of the discharge path limiting plate 72, and each lead portion 72*a* is electrically connected to the respective distal end parts of discharge path limiting plate stem pins (fourth stem pins) 9B which are disposed in a standing position in the stem 65.

A loading port 77 which extends in a perpendicular direction to the tube axis G is formed in the second support portion 70 for loading a first discharge path limiting portion 76 made of a conductive metal (for example molybdenum, tungsten, or an alloy thereof) from the side. A first opening 78 with a larger diameter than the second opening 73 is formed in the first discharge path limiting portion 76 for narrowing the discharge path, and this first opening 78 is positioned on the same tube axis G as the second opening 73.

The first opening 78 comprises a funnel-shaped part 78*a* which extends in a perpendicular direction to the tube axis G for producing a favorable arc ball, and this funnel-shaped part 78*a* narrows in diameter from the light exit window 64 toward the anode portion 68. More specifically, the funnel-shaped part 78*a* is formed with a 3.2 mm diameter on the light exit window 64 side, and is formed with a diameter of approximately 1 mm on the anode portion 68 side so as to have a larger opening area than the second opening 73. Thus the discharge path is narrowed by the first opening 78 and second opening 73 in collaboration.

Figure 30:
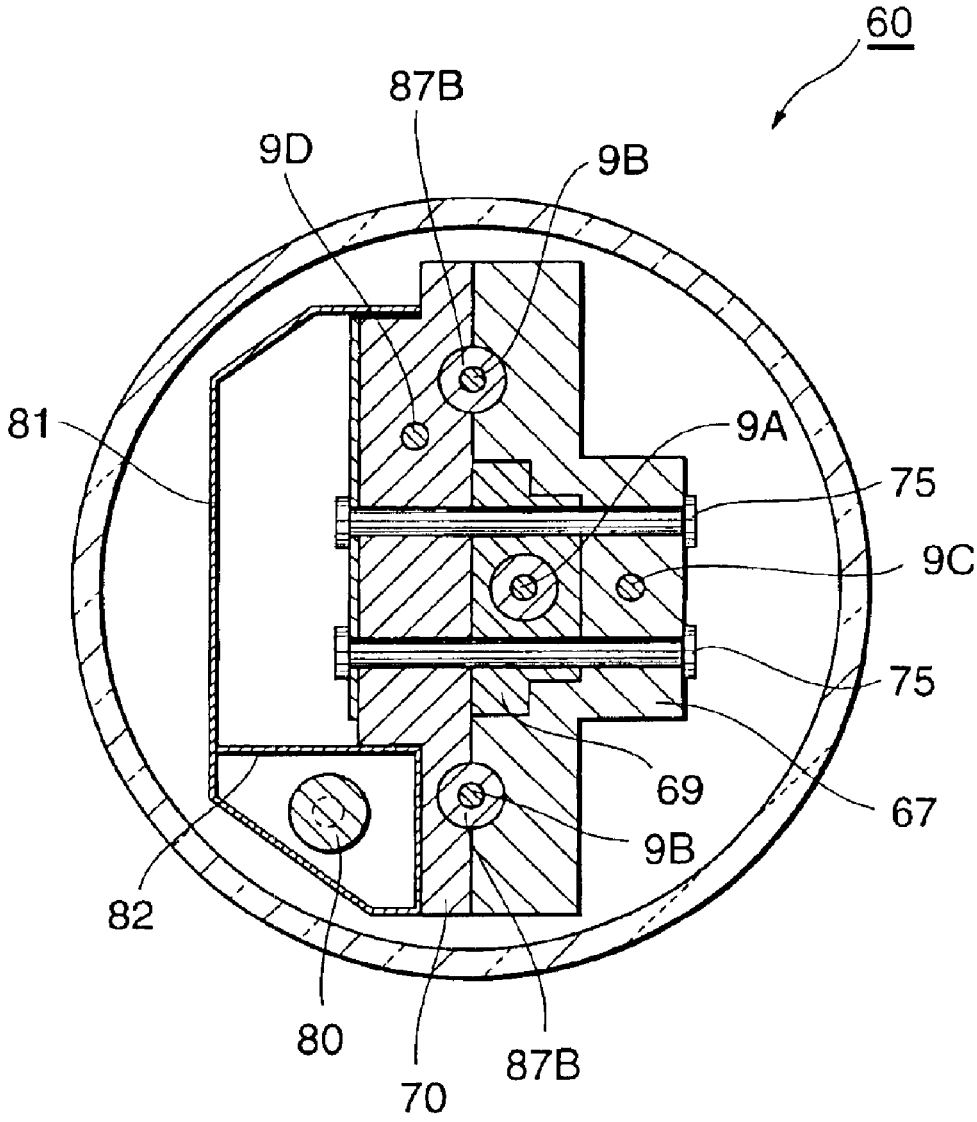
FIG. 30 is a sectional view along the V—V line in FIG. 28.

A conductive plate 79 is disposed in contact with the front face of the second support portion 70, and this conductive plate 79 is fixed by a rivet 75 which passes through the first and second support portions 67, 70 (see FIG. 30). An opening formed in the conductive plate 79 is aligned with the loading port 77, enabling the first discharge path limiting portion 76 to be loaded therein. The conductive plate 79 extends rearward along the surface of the first support portion 67 and second support portion 70, and is electrically connected to the respective distal end parts of discharge path limiting plate stem pins (third stem pins) 9C which are disposed in a standing position in the stem 65 and pass through the first support portion 67.

A flange portion 76*a* provided on the first discharge path limiting portion 76 is disposed on the conductive plate 79 in contact therewith, and by welding the flange portion 76*a* to the conductive plate 79, the conductive plate 79 and first discharge path limiting portion 76 are integrated.

Here, the first discharge path limiting portion 76 and second discharge path limiting portion 72 are separated by a space portion G in order to provide electrical insulation therebetween. In order to further ensure this insulation, the first discharge path limiting portion 76 and second support portion 70 are also separated. The reason for this is that when the first discharge path limiting portion 76 and second discharge path limiting portion 72 reach a high temperature during an operation of the lamp, sputtering material and evaporated material are generated from the first discharge path limiting portion 76 and second discharge path limiting portion 72, and metallic evaporated material at this time is actively caused to adhere to the wall face of the loading port 77. Hence, by separating the first discharge path limiting portion 76 and second support portion 70, the area to which metallic evaporated material is adhered increases, as a result of which a short-circuit between the first discharge path limiting portion 76 and second discharge path limiting portion 72 becomes unlikely.

Further, the wall face of the funnel-shaped part 78*a* is processed into a mirror surface. In this case, the wall face may be made into a mirror surface by polishing a simple material substance such as tungsten, molybdenum, palladium, nickel, titanium, gold, silver, or platinum (or an alloy thereof). Alternatively, a mirror surface may be formed using this simple material substance or alloy as a base material, or using a ceramic as abase material, and applying a coating to the material by means of plating processing, vapor deposition processing, or similar. Thus the light emitted from an arc ball is reflected by the mirror surface of the funnel-shaped part 78*a* and condensed toward the light exit window 64, whereby the luminance of the light is increased.

A cathode portion 80 is disposed in the light-emitting portion assembly 66 in a position removed from the optical path on the light exit window 64 side. The two ends of the cathode portion 80 are electrically connected to the respective distal end parts of cathode portion stem pins (second stem pins) 9D disposed in a standing position in the stem 65 via connecting pins not shown in the drawings. Thermoelectrons are generated in the cathode portion 80, or more specifically, the cathode portion 80 is provided with a tungsten coil portion which extends in the direction of the tube axis G and generates thermoelectrons.

The cathode portion 80 is housed inside a cap-form metallic front cover 81. The front cover 81 is fixed by being bent following the insertion of a claw piece 81*a* provided thereon into a slit hole (not shown) provided in the first support portion 67. Also, a rectangular light transmitting port 81*b* is formed in the front cover 81 at the part which opposes the light exit window 64.

A discharge current plate 82 is provided inside the front cover 81 in a position removed from the optical path between the cathode portion 80 and first discharge path limiting portion 76. An electron-emitting window 82*a* of the discharge current plate 82 is formed as a rectangular opening for allowing the transmission of thermoelectrons. The discharge current plate 82 is fixed by being bent following the insertion of a claw piece 82*b* provided thereon into a slit hole (not shown) provided in the first support portion 67. Thus the cathode portion 80 is surrounded by the front cover 81 and discharge current plate 82 such that sputtering material or evaporated material emitted from the cathode portion 80 does not adhere to the light exit window 64.

The light-emitting portion assembly 66 constituted in this manner is provided within the hermetically sealed container 62, and since the interior of the hermetically sealed container 62 must be filled with deuterium gas at several hundred Pa, a glass exhaust pipe 86 is formed integrally with the hermetically sealed container 62. This exhaust pipe 86 is sealed by being fused at the end of the assembly process after the air inside the hermetically sealed container 62 has been removed and deuterium gas at a predetermined pressure has been appropriately filled therein. Note that all of the stem pins 9A to 9D disposed in standing positions in the stem 65 may be protected by ceramic electrical insulation tubes, and at least the stem pins 9A and 9B are enveloped by tubes 87A and 87B.

The operational principles of the side-on type deuterium lamp 60 constituted in this manner are similar to those of the aforementioned head-on type deuterium lamp 1, and hence description thereof is omitted. A larger voltage is applied to the second discharge path limiting plate 72 than the first discharge path limiting portion 76. When a voltage of 120V is applied to the second discharge path limiting portion 72, for example, 100V are applied to the first discharge path limiting portion 76. When different voltages are applied to the first discharge path limiting portion 76 and second discharge path limiting portion 72 in this manner, an electric field is produced between the first discharge path limiting portion 76 and second discharge path limiting portion 72, and thus movement of electrons from the vicinity of the first discharge path limiting portion 76 to the second discharge path limiting portion 72 can be actively performed.

Next, other embodiments of a side-on type gas discharge tube will be described, but the descriptions thereof will be limited to substantial differences with the eighth embodiment. Identical or similar constitutional components to the eighth embodiment have been allocated identical reference symbols and description thereof has been omitted.

(Ninth Embodiment)

Figure 31:
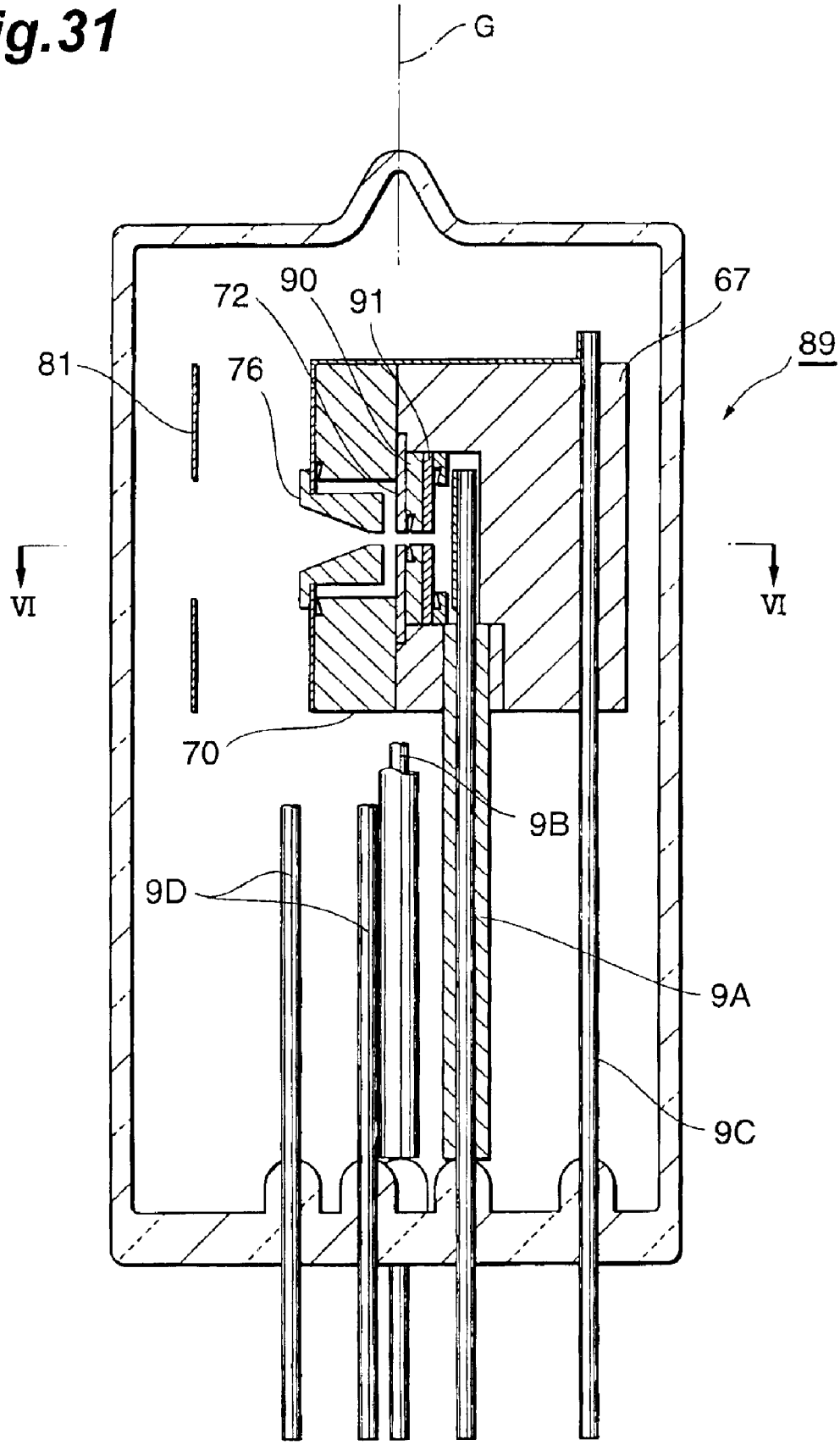
FIG. 31 is a sectional view showing a ninth embodiment of a gas discharge tube.
Figure 32:
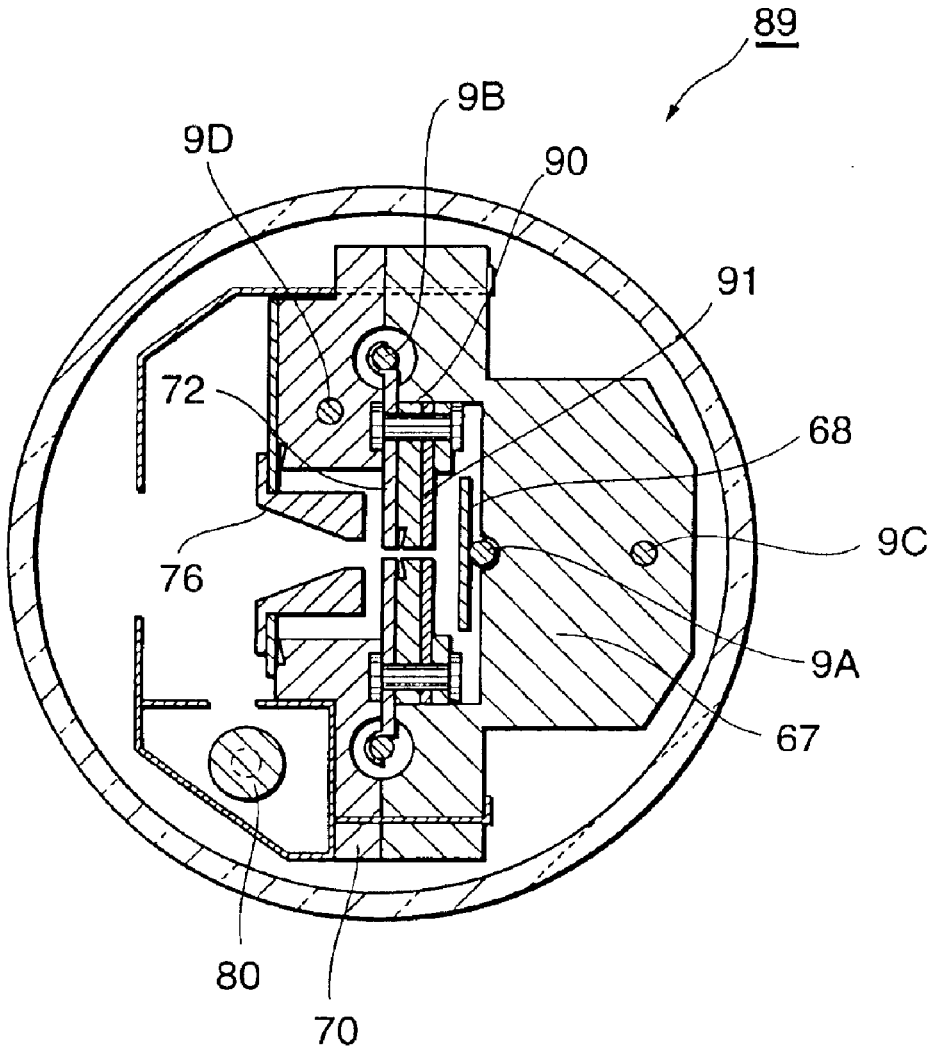
FIG. 32 is a sectional view along the VI—VI line in FIG. 31.
Figure 33:
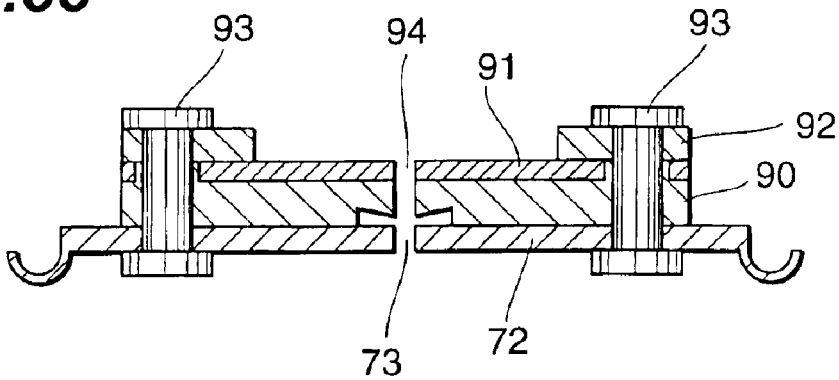
FIG. 33 is an enlarged sectional view of the main parts of the gas discharge tube shown in FIG. 32.

As shown in FIGS. 31, 32, and 33, in a gas discharge tube 89 an electrically insulating ceramic spacer 90 is disposed on the rear face of a second discharge path limiting portion 72 and a third discharge path limiting portion 91 is disposed on the rear face of the spacer 90. The third discharge path limiting portion 91 is gripped between the spacer 90 and an electrical insulation plate 92, and the second discharge path limiting portion 72 and third discharge path limiting portion 91 are integrated by a rivet 93. The plate-form second discharge path limiting portion 72 is fixed by being gripped between the front face of a first support portion 67 and the back face of a second support portion 70.

A third opening 94 is formed in the center of the third discharge path limiting portion 91 for narrowing the discharge path. This third opening 94 may have an identical or a different diameter to a second opening 73 of the second discharge path limiting portion 72. If the third opening 91 is formed with a 0.1 mm diameter while the diameter of the second opening 73 is 0.3 mm, for example, the discharge path can be further narrowed to thereby achieve a further increase in luminance.

Figure 34:
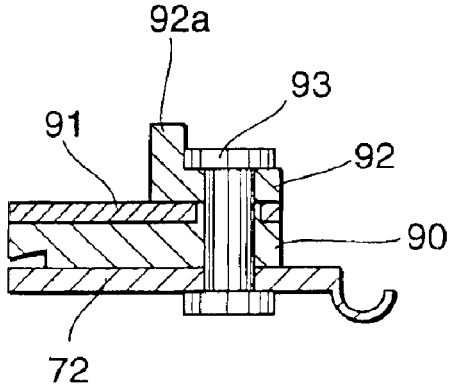
FIG. 34 is a sectional view showing another example of a fixing method using a rivet.
Figure 35:
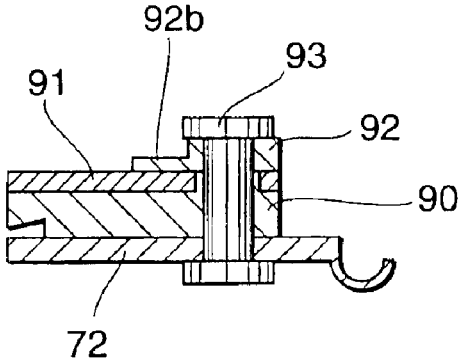
FIG. 35 a sectional view showing a further example of a fixing method using a rivet.
Figure 36:
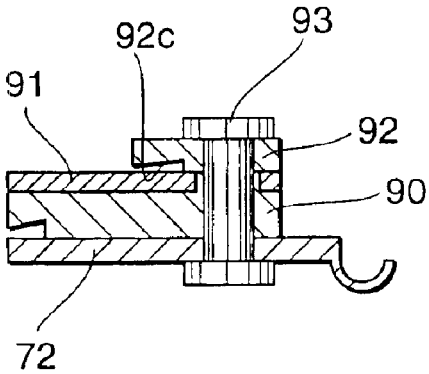
FIG. 36 a sectional view showing a further example of a fixing method using a rivet.

Note that when the rivet 93 reaches a high temperature during an operation of the lamp, sputtering material and evaporated material are generated from the head part of the rivet 93. Hence, as shown in FIG. 34, a barrier 92*a* is caused to protrude from the electrical insulation plate 92, making it difficult for metallic sputtering material generated from the rivet 93 to adhere to the third discharge path limiting portion 91 and making a short-circuit between the second discharge path limiting portion 72 and third discharge path limiting portion 91 through which the rivet 93 is disposed unlikely. Further, as shown in FIG. 35, a cut portion 92*b* is provided on the surface of the electrical insulation plate 92 to enlarge the area to which metallic evaporated material may adhere. Similarly, as shown in FIG. 36, a cut portion 92*c* is provided on the rear surface of the electrical insulation plate 92 to enlarge the area to which metallic evaporated material may adhere.

(Tenth Embodiment)

Figure 37:
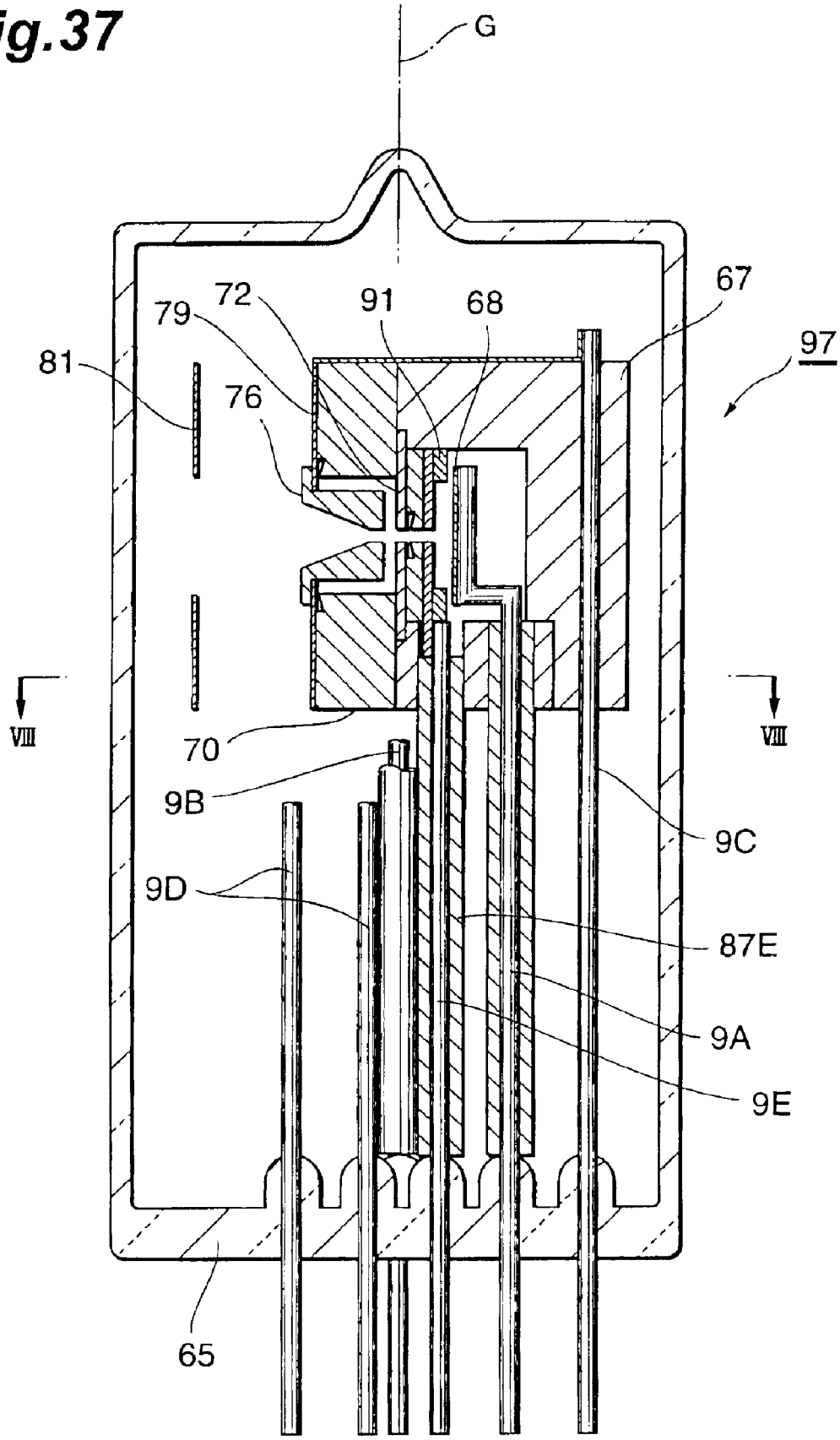
FIG. 37 is a sectional view showing a tenth embodiment of a gas discharge tube.
Figure 38:
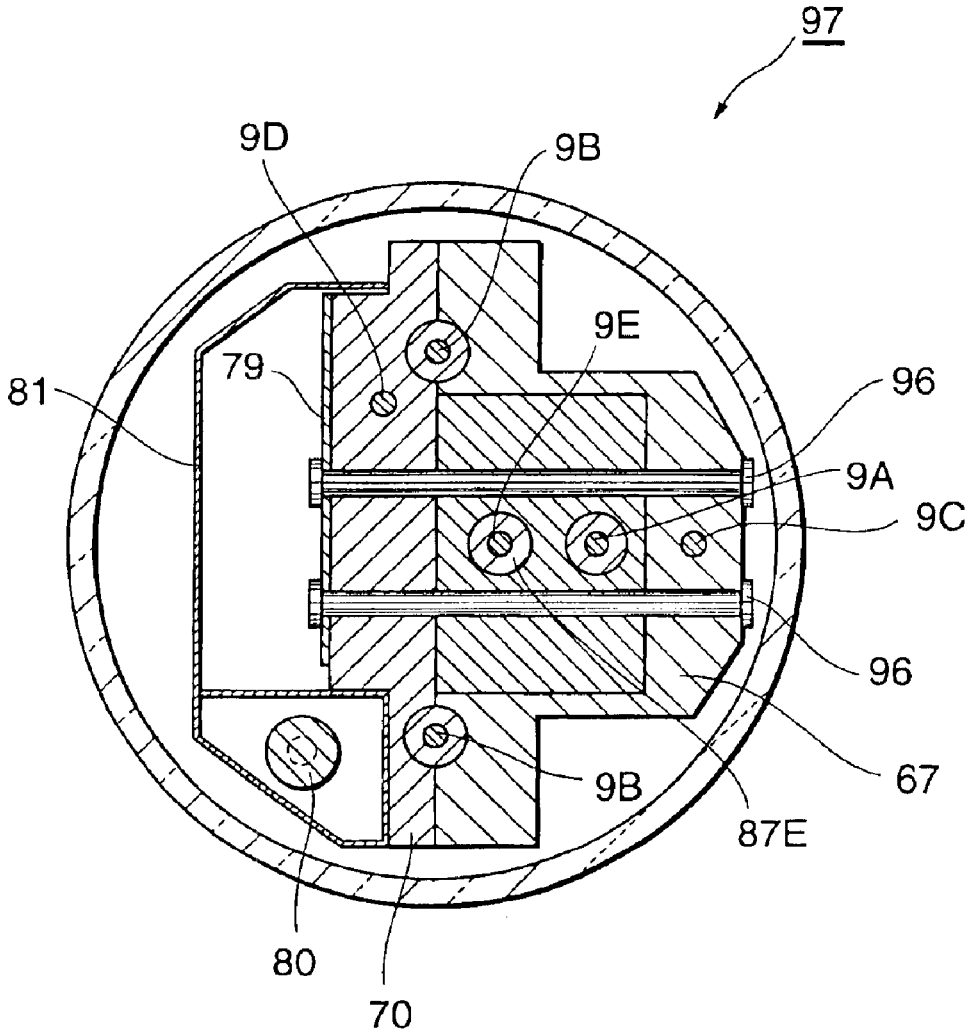
FIG. 38 is a sectional view along the VIII—VIII line in FIG. 37.

As shown in FIGS. 37 and 38, in a gas discharge tube 97 a second discharge path limiting portion 72 is electrically connected to the distal ends of fourth stem pins 9B disposed in a standing position in a stem 65 so that different potentials can be applied to the second discharge path limiting portion 72 and a third discharge path limiting portion 91. The third discharge path limiting portion 91, on the other hand, is electrically connected to the distal end part of a fifth stem pin 9E disposed in a standing position in the stem 65. Note that the symbol 87E refers to an electrical insulation tube which protects the stem pin 9E.

Next, various circuits used for operating the aforementioned gas discharge tube will be described on the basis of the drawings. Note that in FIGS. 39 to 42, the symbols C1, C2 refer to a cathode portion S terminal, the symbol C3 refers to an anode portion, the symbol C4 refers to a first discharge path limiting portion, the symbol C5 refers to a second discharge path limiting portion, the symbol C6 refers to a third discharge path limiting portion, the symbol 1 refers to a main power source, the symbol 2 refers to a trigger power source, the symbol 3 refers to a power source for heating the cathode, and the symbol 4 refers to a thyristor.

Figure 39:
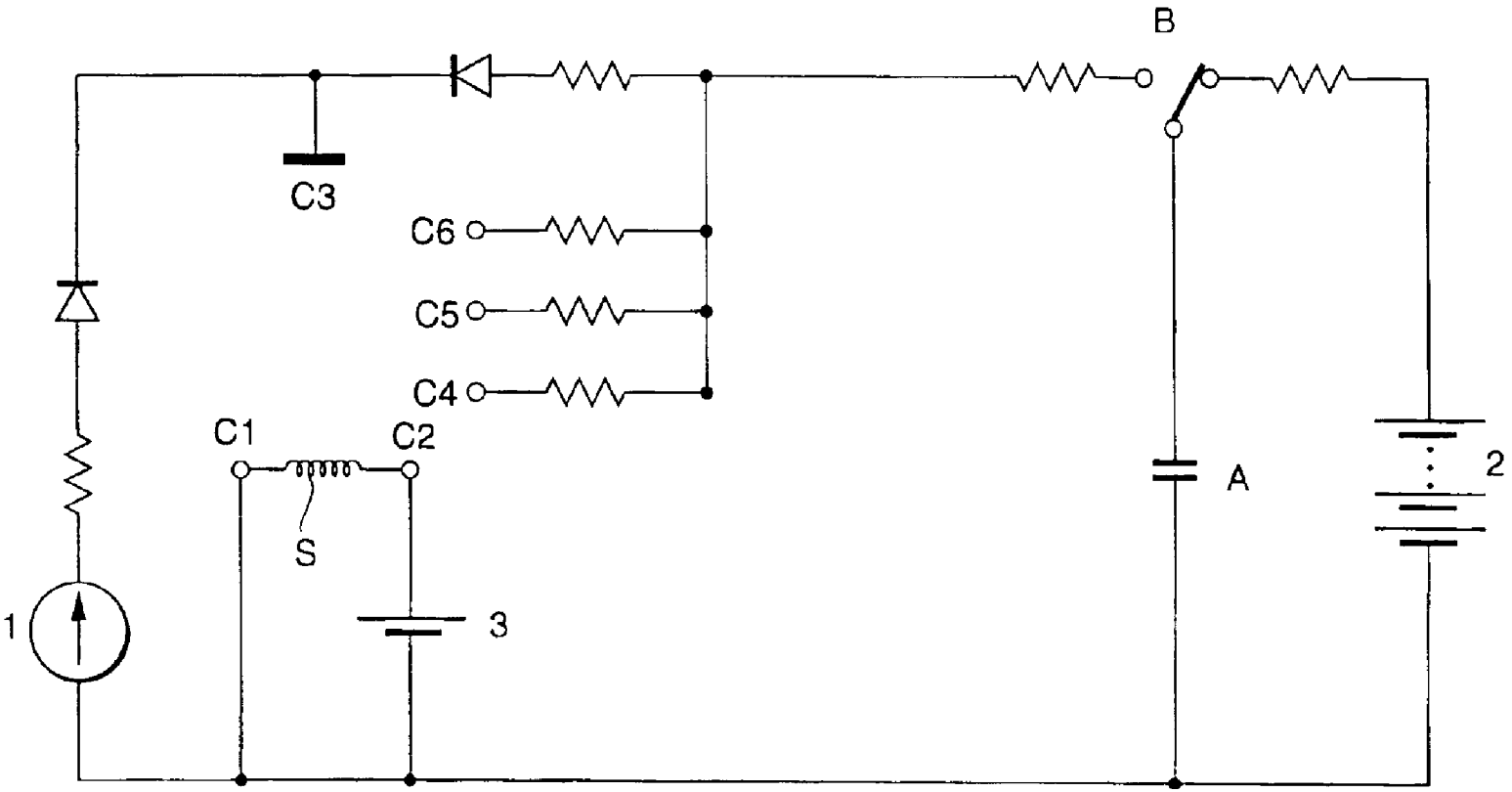
FIG. 39 is a view showing a first driving circuit applied to the gas discharge tube.

A first driving circuit illustrated in FIG. 39 will be described. First, electric power of approximately 10 W is supplied between the terminal C1 and terminal C2 from the power source 3 to heat the cathode portion S, and a condenser A is charged by the trigger power source 2. Then 160V are applied between the terminal Cl and anode portion C3 from the main power source 1. The time at which the cathode portion S has been sufficiently heated is then judged, whereupon a switch B is switched such that a voltage of 160V is applied between C1 and C3, a voltage of 160V is applied between the terminal C1 and C4, a voltage of 160V is applied between C1 and C5, and a voltage of 160V is applied between C1 and C6 using power supplied by the condenser A.

At this time discharge is produced between the cathode portion S and first discharge path limiting portion C4, and the voltage between the cathode portion S and first discharge path limiting portion C4 drops. As a result of this drop in voltage, the potential difference between the first discharge path limiting portion C4 and second discharge path limiting portion C5 increases such that charged particles existing in the vicinity of the first discharge path limiting portion C4 move to the second discharge path limiting portion C5. Thus discharge is produced between the cathode portion S and second discharge path limiting portion C5, and the voltage between the cathode portion S and second discharge path limiting portion C5 drops. Note that the discharge between the cathode portion S and first discharge path limiting portion C4 continues.

As a result of this drop in voltage the potential difference between the second discharge path limiting portion C5 and third discharge path limiting portion C6 increases such that charged particles existing in the vicinity of the second discharge path limiting portion C5 move to the third discharge path limiting portion C6. Thus discharge is produced between the cathode portion S and third discharge path limiting portion C6 and the voltage between the cathode portion S and third discharge path limiting portion C6 drops. Note that the discharge between the cathode portion S and the first and second discharge path limiting portions C4, C5 continues.

As a result of this drop in voltage, the potential difference between the third discharge path limiting portion C6 and anode portion C3 increases such that charged particles existing in the vicinity of the third discharge path limiting portion C6 move to the anode portion C3. Thus a starting discharge is generated between the cathode portion S and anode portion C3. Note that the discharge between the cathode portion Sand the first, second, and third discharge path limiting portions C4, C5, C6 continues. Due to the starting discharge, discharge between the cathode portion S and anode portion C3 can be maintained by the main power source 1 such that the lamp is continuously illuminated. Note that starting discharge ends when the discharge of the condenser A is complete.

Figure 40:
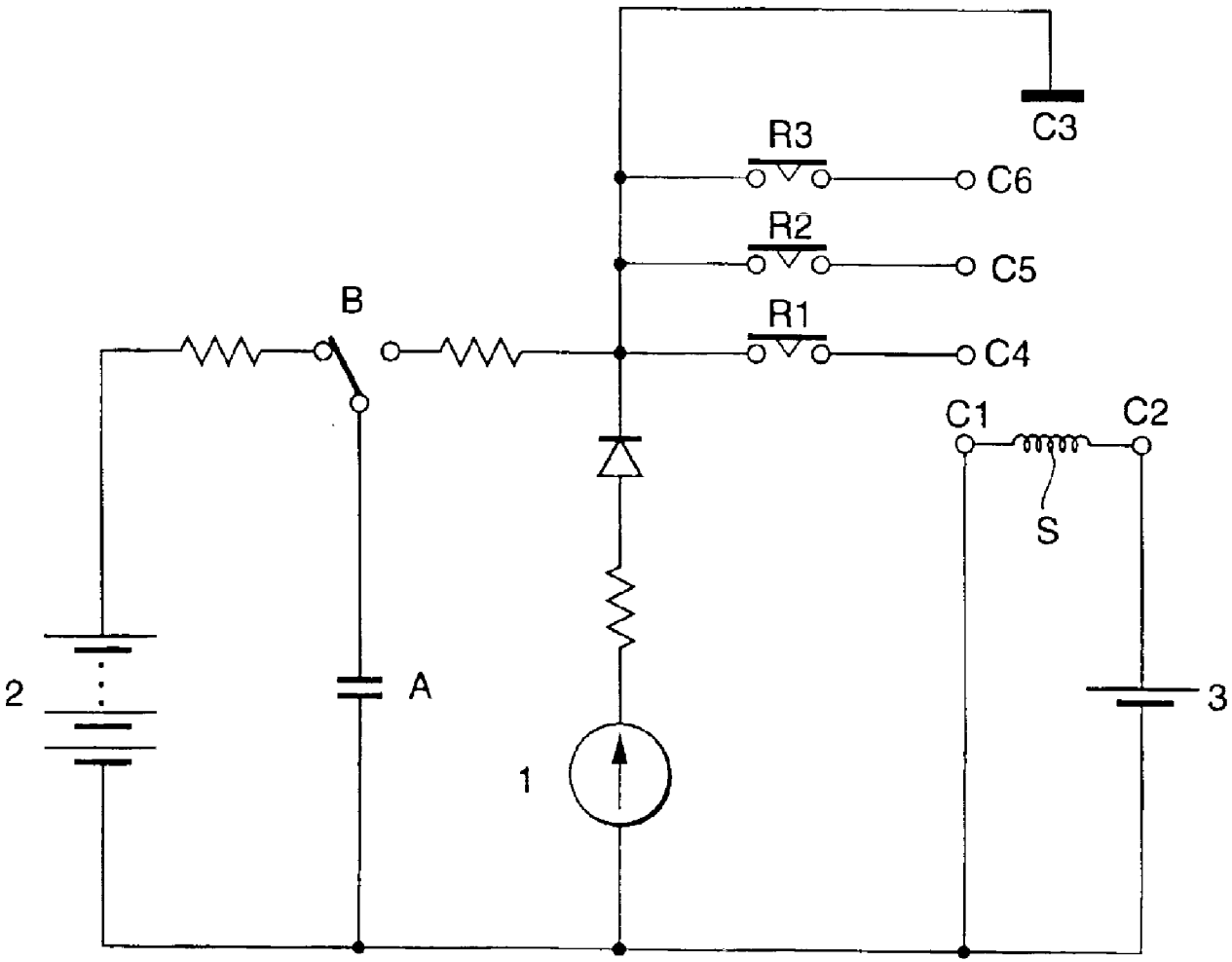
FIG. 40 is a view showing a second driving circuit applied to the gas discharge tube.

A second driving circuit illustrated in FIG. 40 will now be described. First, electric power of approximately 10 W is supplied between the terminal C1 and terminal C2 from the power source 3 to heat the cathode portion S, and the condenser A is charged by the trigger power source 2. Then 160V are applied between the terminal C1 and anode portion C3 by the main power source 1. The time at which the cathode portion S has been sufficiently heated is then judged, whereupon the switch B is switched such that a voltage of 160V is applied between C1 and C3, a voltage of 160V is applied between C1 and C4, a voltage of 160V is applied between C1 and C5, and a voltage of 160V is applied between C1 and C6 using power supplied from the condenser A.

At this time discharge is produced between the cathode portion S and first discharge path limiting portion C4, and the voltage between the cathode portion S and first discharge path limiting portion C4 drops. Then, when a current is detected between the cathode portion S and first discharge path limiting portion C4 by a current detection portion provided between a relay switch R1 and the first discharge path limiting portion C4, the relay switch R1 is opened such that discharge between the cathode portion S and first discharge path limiting portion C4 is halted.

Charged particles existing in the vicinity of the first discharge path limiting portion C4 then move to the second discharge path limiting portion C5. As a result, discharge is generated between the cathode portion S and second discharge path limiting portion C5, and the voltage between the cathode portion S and second discharge path limiting portion C5 drops. Then, when a current is detected between the cathode portion S and second discharge path limiting portion C5 by a current detection portion provided between a relay switch R2 and the second discharge path limiting portion C5, the relay switch R2 is opened such that discharge between the cathode portion S and second discharge path limiting portion C5 is halted.

Charged particles existing in the vicinity of the second discharge path limiting portion C5 then move to the third discharge path limiting portion C6. As a result discharge is generated between the cathode portion S and the third discharge path limiting portion C6, and the voltage between the cathode portion S and third discharge path limiting portion C6 drops. Then, when a current is detected between the cathode portion S and third discharge path limiting portion C6 by a current detection portion provided between a relay switch R3 and the third discharge path limiting portion C6, the relay switch R3 is opened such that discharge between the cathode portion S and third discharge path limiting portion C6 is halted.

Charged particles existing in the vicinity of the third discharge path limiting portion C6 then move to the anode portion C3. As a result, a starting discharge is generated between the cathode portion S and anode portion C3. Due to the starting discharge, discharge between the cathode portion S and anode portion C3 can be maintained by the main power source 1 such that the lamp is continuously illuminated.

Figure 41:
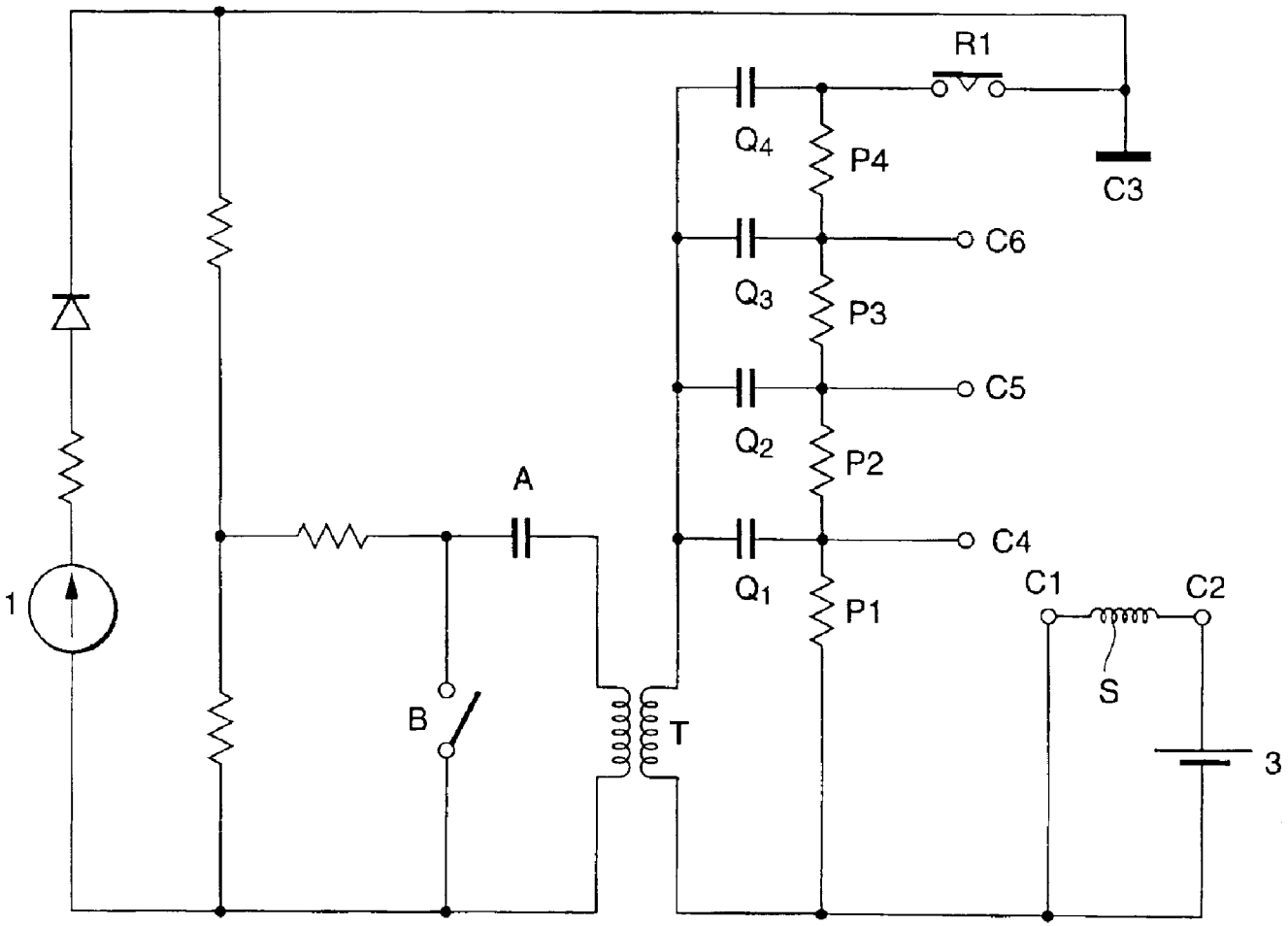
FIG. 41 is a view showing a third driving circuit applied to the gas discharge tube.

A third driving circuit illustrated in FIG. 41 will now be described. First, electric power of approximately 10 W is supplied between the terminal C1 and terminal C2 from the power source 3 to heat the cathode portion S. The condenser A is then charged by the main power source 1, whereupon 160V are applied between the terminal C1 and the anode portion C3 and a potential gradient is formed by resistance P1, resistance P2, resistance P3, and resistance P4. The time at which the cathode portion S has been sufficiently heated is then judged, whereupon the switch B is switched ON such that when a charge is emitted from the condenser A, a high voltage pulse is generated by a pulse transformer T.

This pulse voltage is applied to the first discharge path limiting portion C4, second discharge path limiting portion C5, third discharge path limiting portion C6, and anode portion C3 respectively through pulse condensers Q1 to Q4. Starting discharges are then generated between the cathode portion S and first discharge path limiting portion C4, the first discharge path limiting portion C4 and second discharge path limiting portion C5, the second discharge path limiting portion C5 and third discharge path limiting portion C6, and the third discharge path limiting portion C6 and anode portion C3. Due to these starting discharges, discharge between the cathode portion S and anode portion C3 can be maintained by the main power source 1 such that the lamp is continuously illuminated. Note that when discharge formation between the cathode portion S and anode portion C3 has been confirmed by a current detection portion provided between the main power source 1 and anode portion C3, the relay switch R1 is opened and starting discharge is halted.

Figure 42:
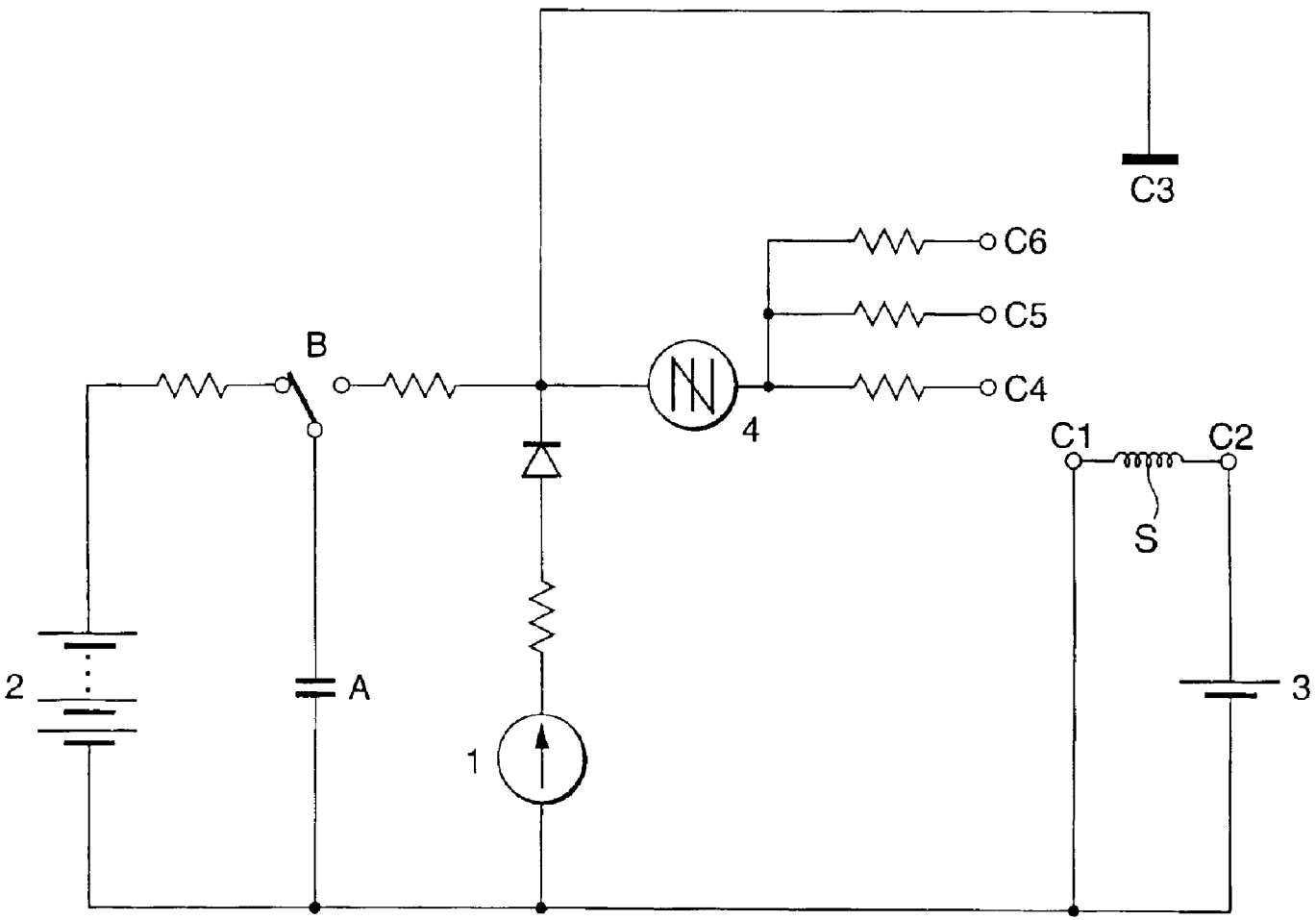
FIG. 42 is a view showing a fourth driving circuit applied to the gas discharge tube.

A fourth driving circuit illustrated in FIG. 42 will now be described. First, electric power of approximately 10 W is supplied between the terminal C1 and terminal C2 from the power source 3 to heat the cathode portion S, and the condenser A is charged by the trigger power source 2. Then 160V are applied between the terminal C1 and anode portion C3 by the main power source 1. The time at which the cathode portion S has been sufficiently heated is then judged, whereupon the switch B is switched such that a voltage of 200V is applied between C1 and C3 and a voltage of 200V is applied between the terminal C1 and the thyristor 4. The generation of a trigger voltage causes the thyristor 4 to enter a conducting state, whereupon a voltage of 200V is applied between C1 and C4, a voltage of 200V is applied between C1 and C5, and a voltage of 200V is applied between C1 and C6.

At this time, discharge is generated between the cathode portion S and first discharge path limiting portion C4 by the charge which charges the condenser A, and the voltage between the cathode portion S and first discharge path limiting portion C4 drops. As a result of this drop in voltage, the potential difference between the first discharge path limiting portion C4 and second discharge path limiting portion C5 increases such that charged particles existing in the vicinity of the first discharge path limiting portion C4 move to the second discharge path limiting portion C5. Thus discharge is generated between the cathode portion S and second discharge path limiting portion C5 and the voltage between the cathode portion S and second discharge path limiting portion C5 drops. Note that the discharge between the cathode portion S and first discharge path limiting portion C4 continues.

As a result of this drop in voltage, the potential difference between the second discharge path limiting portion C5 and third discharge path limiting portion C6 increases such that charged particles existing in the vicinity of the second discharge path limiting portion C5 move to the third discharge path limiting portion C6. Thus discharge is generated between the cathode portion S and third discharge path limiting portion C6 and the voltage between the cathode portion S and third discharge path limiting portion C6 drops. Note that the discharge between the cathode portion S and the first and second discharge path limiting portions C4, C5 continues.

As a result of this drop in voltage, the potential difference between the third discharge path limiting portion C6 and the anode portion C3 increases such that charged particles existing in the vicinity of the third discharge path limiting portion C6 move to the anode portion C3. As a result, a starting discharge is generated between the cathode portion S and anode portion C3. Note that the discharge between the cathode portion S and the first, second, and third discharge path limiting portions C4, C5, C6 continues. Due to this starting discharge, discharge between the cathode portion S and anode portion C3 can be maintained by the main power source 1 such that the lamp is continuously illuminated.

Note that when the sum total of the respective discharge current values between C1 and C4, C1 and C5, and C1 and C6 equals or falls below a current value for setting the thymistor 4 in a state of insulation, the respective starting discharges between C1 and C4, C1 and C5, and C1 and C6 cease.

The gas discharge tube according to the present invention is not limited to the embodiments described above. For example, the aforementioned third discharge path limiting portion 39, 53, 91 may be constituted by a plurality of plates.

INDUSTRIAL APPLICABILITY

The present invention may be used in a gas discharge tube.

What is claimed is:

1. A gas discharge tube which is caused to discharge a predetermined light toward the outside from a light exit window of a hermetically sealed container by sealing gas into said hermetically sealed container, electrically connecting an anode portion and a cathode portion respectively to first and second stem pins disposed in a standing position in a stem which is provided in said hermetically sealed container so as to extend in a tube axis direction, and generating discharge between said anode portion and said cathode portion, said gas discharge tube in comprising:

a first discharge path limiting portion disposed at a point on a discharge path between said anode portion and said cathode portion and having a first opening for narrowing said discharge path;

a second discharge path limiting portion disposed at a point on said discharge path between said first discharge path limiting portion and said anode portion and having a second opening for narrowing said discharge path;

a first electrical insulation portion disposed between said first discharge path limiting portion and said second discharge path limiting portion;

a third stem pin disposed in a standing position in said stem so as to extend in said tube axis direction, the distal end part of which is electrically connected to said first discharge path limiting portion;

a fourth stem pin disposed in a standing position in said stem so as to extend in said tube axis direction, the distal end part of which is electrically connected to said second discharge path limiting portion; and a light-emitting portion assembly which houses said anode portion, said cathode portion, said first discharge path limiting portion, and said second discharge path limiting portion, and which is supported by said first through fourth stem pins, wherein a connecting portion between said second discharge path limiting portion and said fourth stem pin is surrounded by an insulator including said first insulating portion.

2. The gas discharge tube according to claim 1, characterized in that said second discharge path limiting portion is disposed on a second electrical insulation portion so as to contact said second electrical insulation portion.

3. The gas discharge tube according to claim 2, characterized in that said second discharge path limiting portion is fixed by being gripped between said first electrical insulation portion and said second electrical insulation portion.

4. The gas discharge tube according to claim 1, characterized in further comprising:

a third discharge path limiting portion disposed at a point on said discharge path between said second discharge path limiting portion and said anode portion and having a third opening for narrowing said discharge path; and a fifth stem pin disposed in a standing position in said stem so as to extend in said tube axis direction, the distal end part of which is electrically connected to said third discharge path limiting portion.

5. The gas discharge tube according to claim 4, characterized in that an electrical insulation portion is disposed between said second discharge path limiting portion and said third discharge path limiting portion.

6. The gas discharge tube according to claim 4, characterized in that a higher voltage is applied to said third discharge path limiting portion than to said second discharge path limiting portion.

7. The gas discharge tube according to claim 4, characterized in that said third discharge path limiting portion is disposed on a second electrical insulation portion so as to contact said second electrical insulation portion.

8. The gas discharge tube according to claim 7, characterized in that said third discharge path limiting portion is fixed by being gripped between said second electrical insulation portion and a third electrical insulation portion.

9. The gas discharge tube according to claim 1, characterized in that said second opening has a smaller opening area than said first opening.

10. The gas discharge tube according to claim 1, characterized in that said first opening of said first discharge path limiting portion comprises a funnel-shaped part which decreases in diameter from said light exit window toward said anode portion.

11. The gas discharge tube according to claim 1, characterized in that a higher voltage is applied to said second discharge path limiting portion than to said first discharge path limiting portion.

12. The gas discharge tube according to claim 1, wherein the periphery of said second discharge path limiting portion is exposed.

13. The gas discharge tube according to claim 12, wherein a side of said exposed periphery of said second discharge path limiting portion is said cathode side.

14. The gas discharge tube according to claim 1, wherein a part of an outer surface of said first discharge path limiting portion is opposed to and separates from an inner surface of said first electrical insulation portion via a space.

15. The gas discharge tube according to claim 1, wherein a part defining a minimum diameter of said first opening of said first discharge path limiting portion is positioned inside an aperture of said first electrical insulation portion.

* * * * *